US010783849B2

(12) United States Patent
Ishida et al.

(10) Patent No.: US 10,783,849 B2
(45) Date of Patent: Sep. 22, 2020

(54) DISPLAY DRIVER, ELECTRO-OPTIC DEVICE, AND ELECTRONIC APPARATUS

(71) Applicant: SEIKO EPSON CORPORATION, Tokyo (JP)

(72) Inventors: Jun Ishida, Chino (JP); Takeshi Nomura, Shiojiri (JP); Akihiko Okuda, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 10 days.

(21) Appl. No.: 16/055,383

(22) Filed: Aug. 6, 2018

(65) Prior Publication Data

US 2019/0043440 A1 Feb. 7, 2019

(30) Foreign Application Priority Data

Aug. 7, 2017 (JP) ..... 2017-152113

(51) Int. Cl.
*G09G 3/36* (2006.01)

(52) U.S. Cl.
CPC ..... *G09G 3/3688* (2013.01); *G09G 3/3648* (2013.01); *G09G 2310/027* (2013.01); *G09G 2310/0248* (2013.01); *G09G 2310/0291* (2013.01); *G09G 2330/021* (2013.01)

(58) Field of Classification Search
CPC ..... G09G 3/3688; G09G 3/3648; G09G 2310/0248; G09G 2310/027; G09G 2310/0291; G09G 2330/021
See application file for complete search history.

(56) References Cited

U.S. PATENT DOCUMENTS

| | | | | |
|---|---|---|---|---|
| 2006/0227638 | A1 | 10/2006 | Kudo et al. | |
| 2006/0291309 | A1 | 12/2006 | Maki | |
| 2008/0117235 | A1* | 5/2008 | Morita | G09G 3/3666 345/690 |
| 2009/0002358 | A1* | 1/2009 | Tamura | G09G 3/3688 345/212 |
| 2009/0009510 | A1 | 1/2009 | Shu et al. | |
| 2010/0165011 | A1 | 7/2010 | Kudo et al. | |
| 2015/0002503 | A1 | 1/2015 | Park et al. | |

FOREIGN PATENT DOCUMENTS

| | | | |
|---|---|---|---|
| JP | 2006-267675 | A | 10/2006 |
| JP | 2007-4047 | A | 1/2007 |
| JP | 2007-093996 | A | 4/2007 |
| JP | 2007-102132 | A | 4/2007 |
| JP | 2009-14842 | A | 1/2009 |
| JP | 2009-198970 | A | 9/2009 |
| JP | 2010-19908 | A | 1/2010 |

* cited by examiner

*Primary Examiner* — Towfiq Elahi
(74) *Attorney, Agent, or Firm* — Oliff PLC

(57) ABSTRACT

A display driver includes a first data voltage output terminal, a first amplifier circuit configured to output a gray scale voltage during a drive time, and to output a first amplifier precharge voltage during a first precharge period, a first precharge line configured to supply a first precharge line voltage, a first amplifier switching element disposed between the first amplifier circuit and the first data voltage output terminal, and a first precharge line switching element disposed between the first precharge line and the first data voltage output terminal.

20 Claims, 14 Drawing Sheets

DISPLAY DRIVER, ELECTRO-OPTIC DEVICE, AND ELECTRONIC APPARATUS

The present application is based on and claims priority from JP Application Serial Number 2017-152113, filed Aug. 7, 2017, the disclosure of which is hereby incorporated by reference herein in its entirety.

BACKGROUND

1. Technical Field

The disclosure relates to display drivers, electro-optic devices, and electronic apparatuses.

2. Related Art

Precharging is a known technique to apply predetermined precharge voltages to pixels before data voltages are written into the pixels in electro-optic devices such as liquid crystal display devices. Precharging is performed for purposes of, for example, supplementary data voltage writing and image quality improvement. For the supplementary data voltage writing, precharge voltages close to data voltages to be written in pixels are applied to the pixels beforehand to reduce insufficient writing of data voltages (differences between the voltages actually written in the pixels and the data voltages). For the image quality improvement, precharging reduces causes that affect the image quality, such as leakage of pixel charges (leakage in transistors that couple pixel capacitances with data lines).

One such precharge technique is described in, for example, JP-A-2010-019908. In JP-A-2010-019908, a display device includes a power source for precharging that outputs precharge voltages, signal lines to which pixel signals are applied, and switches disposed between the power source and the outputs of the signal lines. The switches are turned on during a precharge period, and the precharge voltages are output to the signal lines via the switches.

Since the numbers of pixels and the display frame rates of the electro-optic panels tend to increase these years, the drive time per pixel is reduced. This may cause a shorter precharge period, and the speed of writing precharge voltages may be insufficient. For example, at the end of the precharge period, the voltages of the pixels may not reach the precharge voltages. In addition, the distances from precharge terminals of a display driver to each of the data lines vary in precharging using an external power source as described in JP-A-2010-019908. This may cause differences in the speed of writing the precharge voltages at between the data lines close to the precharge terminals and the data lines far from the precharge terminals, and thus the voltages that reach at the end of the precharge period may differ.

SUMMARY

According to some aspects of the disclosure, a display driver, an electro-optic device, and an electronic apparatus configured to rectify insufficiency of speed of writing precharge voltage can be provided.

According to one aspect of the disclosure, a display driver includes a first data voltage output terminal, a first amplifier circuit configured to output a gray scale voltage during a drive time, and to output a first amplifier precharge voltage during a first precharge period, a first precharge line configured to supply a first precharge line voltage, a first amplifier switching element disposed between the first amplifier circuit and the first data voltage output terminal, and a first precharge line switching element disposed between the first precharge line and the first data voltage output terminal.

According to one aspect of the disclosure, the first amplifier precharge voltage is output from the first amplifier circuit during the first precharge period. This enables an electro-optic panel to be precharged using the first precharge line voltage supplied from the first precharge line and the first amplifier precharge voltage supplied from the first amplifier circuit to rectify insufficiency of speed of writing the precharge voltage. For example, effects of image quality improvement and supplementary writing by precharging are enhanced.

According to one aspect of the disclosure, the first amplifier switching element and the first precharge line switching element may be turned on during a first period of the first precharge period, and the first amplifier switching element may be turned off and the first precharge line switching element may be turned on during a second period of the first precharge period, the second period being subsequent to the first period.

This enables the electro-optic panel to be precharged using both the first precharge line voltage and the first amplifier precharge voltage during the first period. In addition, the first amplifier circuit may prepare to output the next voltage during the second period. For example, the first amplifier circuit may output a voltage different from the first precharge line voltage since the first amplifier switching element is turned off during the second period.

According to one aspect of the disclosure, the display driver may further include a first precharge terminal configured to supply the first precharge line voltage to the first precharge line from outside the display driver.

This enables precharging using a precharge line voltage from, for example, a power supply circuit a power supply circuit disposed outside the display driver. Supplying the precharge line voltage from outside enables noise that occurs during precharging to be reduced. This reduces the risk that the display driver may malfunctions during, for example, precharging.

According to one aspect of the disclosure, the display driver may further include a second precharge line configured to supply a second precharge line voltage and a second precharge line switching element disposed between the second precharge line and the first data voltage output terminal.

This enables the electro-optic panel to be precharged using the first precharge line voltage and the second precharge line voltage. For example, precharging for image quality improvement is performed using the first precharge line voltage, and precharging for supplementary writing is performed using the second precharge line voltage.

According to one aspect of the disclosure, the first precharge line voltage may be a negative voltage with respect to a common voltage, and the second precharge line voltage may be a positive voltage with respect to the common voltage. The first precharge line switching element may be turned on during the first precharge period in a positive period, and the second precharge line switching element may be turned on during a second precharge period subsequent to the first precharge period in the positive period.

This enables the first precharge line voltage to be supplied from the first precharge line to the first data voltage output terminal via the first precharge line switching element during the first precharge period. Moreover, the second precharge line voltage is supplied from the second precharge line to the first data voltage output terminal via the second precharge line switching element during the second precharge period. In this manner, two steps of precharging are performed during the horizontal scanning period. The first precharge line voltage that is negative with respect to the common voltage enables, for example, precharging for image quality improvement. Moreover, the second precharge line voltage that is positive with respect to the common voltage enables, for example, precharging for supplementary writing in positive driving.

According to one aspect of the disclosure, the first amplifier circuit may output the first amplifier precharge voltage lower than the first precharge line voltage during the first precharge period in the positive period, and may output a second amplifier precharge voltage higher than the second precharge line voltage during the second precharge period in the positive period.

This enables the precharging speed in the positive period to be increased compared with a case where the precharge line voltage and the amplifier precharge voltage are identical to each other. That is, the voltages during precharging are changed rapidly, resulting in a reduction in time to reach target voltages (the first and second precharge line voltages).

According to one aspect of the disclosure, the display driver may further include a third precharge line configured to supply a third precharge line voltage, a fourth precharge line configured to supply a fourth precharge line voltage, a third precharge line switching element disposed between the third precharge line and the first data voltage output terminal, and a fourth precharge line switching element disposed between the fourth precharge line and the first data voltage output terminal.

This enables the electro-optic panel to be precharged using the third precharge line voltage and the fourth precharge line voltage. For example, precharging is performed using the first precharge line voltage and the second precharge line voltage in the positive period and using the third precharge line voltage and the fourth precharge line voltage in a negative period.

According to one aspect of the disclosure, the third precharge line voltage may be a negative voltage with respect to the common voltage, and the fourth precharge line voltage may be a negative voltage with respect to the common voltage and higher than the third precharge line voltage. The third precharge line switching element may be turned on during the first precharge period in a negative period, and the fourth precharge line switching element may be turned on during the second precharge period subsequent to the first precharge period in the negative period.

This enables the third precharge line voltage to be supplied from the third precharge line to the first data voltage output terminal via the third precharge line switching element during the first precharge period. Moreover, the fourth precharge line voltage is supplied from the fourth precharge line to the first data voltage output terminal via the fourth precharge line switching element during the second precharge period. In this manner, two steps of precharging are performed during the horizontal scanning period. The third precharge line voltage that is negative with respect to the common voltage enables, for example, precharging for image quality improvement. Moreover, the fourth precharge line voltage that is negative with respect to the common voltage and higher than the third precharge line voltage enables, for example, precharging for supplementary writing in negative driving.

According to one aspect of the disclosure, the first amplifier circuit may output a third amplifier precharge voltage lower than the third precharge line voltage during the first precharge period in the negative period, and may output a fourth amplifier precharge voltage higher than the fourth precharge line voltage during the second precharge period in the negative period.

This enables the precharging speed in the negative period to be increased compared with the case where the precharge line voltage and the amplifier precharge voltage are identical to each other. That is, the voltages during precharging are changed rapidly, resulting in a reduction in time to reach target voltages (the third and fourth precharge line voltages).

According to one aspect of the disclosure, the first precharge line switching element, the third precharge line switching element, and the fourth precharge line switching element may be N-type transistors, and the second precharge line switching element may be a P-type transistor.

The first, third, and fourth precharge line voltages are negative voltages lower than the common voltage. Thus, N-type transistors may be used as the first, third, and fourth precharge line switching elements. Moreover, the second precharge line voltage is a positive voltage higher than the common voltage. Thus, a P-type transistor may be used as the second precharge line switching element.

According to one aspect of the disclosure, the display driver may further include a second data voltage output terminal, a second amplifier circuit configured to output a gray scale voltage during the drive time, a second amplifier switching element disposed between the second amplifier circuit and the second data voltage output terminal, and a fifth precharge line switching element disposed between the first precharge line and the second data voltage output terminal.

This enables the first precharge line voltage to be output from the first precharge line to the first data voltage output terminal via the first precharge line switching element and to the second data voltage output terminal via the fifth precharge line switching element during the first precharge period.

According to one aspect of the disclosure, the second amplifier circuit may output the first amplifier precharge voltage during the first precharge period.

This enables the first and second amplifier circuits that drive the data lines located at different lateral positions on the electro-optic panel to output the first amplifier precharge voltage during the first precharge period. This reduces variations in precharging speed in the lateral direction of the electro-optic panel.

According to one aspect of the disclosure, a distance between a supply node configured to supply the first precharge line voltage to the first precharge line and the first amplifier switching element may be longer than a distance between the supply node and the second amplifier switching element, and a driving capability of the first amplifier circuit may be higher than a driving capability of the second amplifier circuit.

This allows the amplifier circuit of which amplifier switching element is remote from the supply node that supplies the first precharge line voltage to have higher driving capability than the amplifier circuit of which amplifier switching element is close to the supply node. This reduces variations in precharging speed in the lateral direction of the electro-optic panel.

According to one aspect of the disclosure, the first amplifier switching element may be turned on during the first period of the first precharge period, and may be turned off during the second period of the first precharge period, the second period being subsequent to the first period. The second amplifier switching element may be turned off during the first precharge period.

This enables both the precharge line voltage and the amplifier precharge voltage to be used at positions where the amplifier switching element is remote from supply node that supplies the first precharge line voltage, and enables the precharge line voltage to be used at positions where the amplifier switching element is close to the supply node. This reduces variations in precharging speed in the lateral direction of the electro-optic panel.

According to one aspect of the disclosure, the first amplifier switching element may be turned on during the first period of the first precharge period, and may be turned off during the second period of the first precharge period subsequent to the first period. The second amplifier switching element may be turned on during a third period of the first precharge period, the third period being shorter than the first period, and turned off during a fourth period of the first precharge period, the fourth period being subsequent to the third period.

This allows the amplifier circuit of which amplifier switching element is remote from the supply node that supplies the first precharge line voltage to output the amplifier precharge voltage for a longer duration than the amplifier circuit of which amplifier switching element is close to the supply node. This reduces variations in precharging speed in the lateral direction of the electro-optic panel.

According to one aspect of the disclosure, the display driver may further include a setting circuit configured to set lengths of the first period and the third period, or to set a timing of switching between the first period and the second period and a timing of switching between the third period and the fourth period.

This enables the lengths of the first period and the third period to be variable and adjustable. Load capacity during precharging varies depending on, for example, the type or model of the electro-optic panel. Thus, the duration for which the precharge line voltage and the amplifier precharge voltage are used together varies depending on the type or model of the electro-optic panel. According to one aspect of the disclosure, the lengths of the first period and the third period are variable and adjustable depending on the type or model of the electro-optic panel.

Another aspect of the disclosure relates to an electro-optic device including the display driver according to any one of the above-described aspects and an electro-optic panel to be driven by the display driver.

Yet another aspect of the disclosure relates to an electronic apparatus including the display driver according to any one of the above-described aspects.

BRIEF DESCRIPTION OF THE DRAWINGS

Embodiments of the disclosure will be described with reference to the accompanying drawings, wherein like numbers reference like elements.

DESCRIPTION OF EXEMPLARY EMBODIMENTS

Exemplary embodiments of the disclosure will now be described in detail. The exemplary embodiments described below do not unduly limit the content of the disclosure described in the claims, and each of the configurations described in the exemplary embodiments may not be a solution of the disclosure.

1. First Configuration Example of Display Driver

Figure 1:
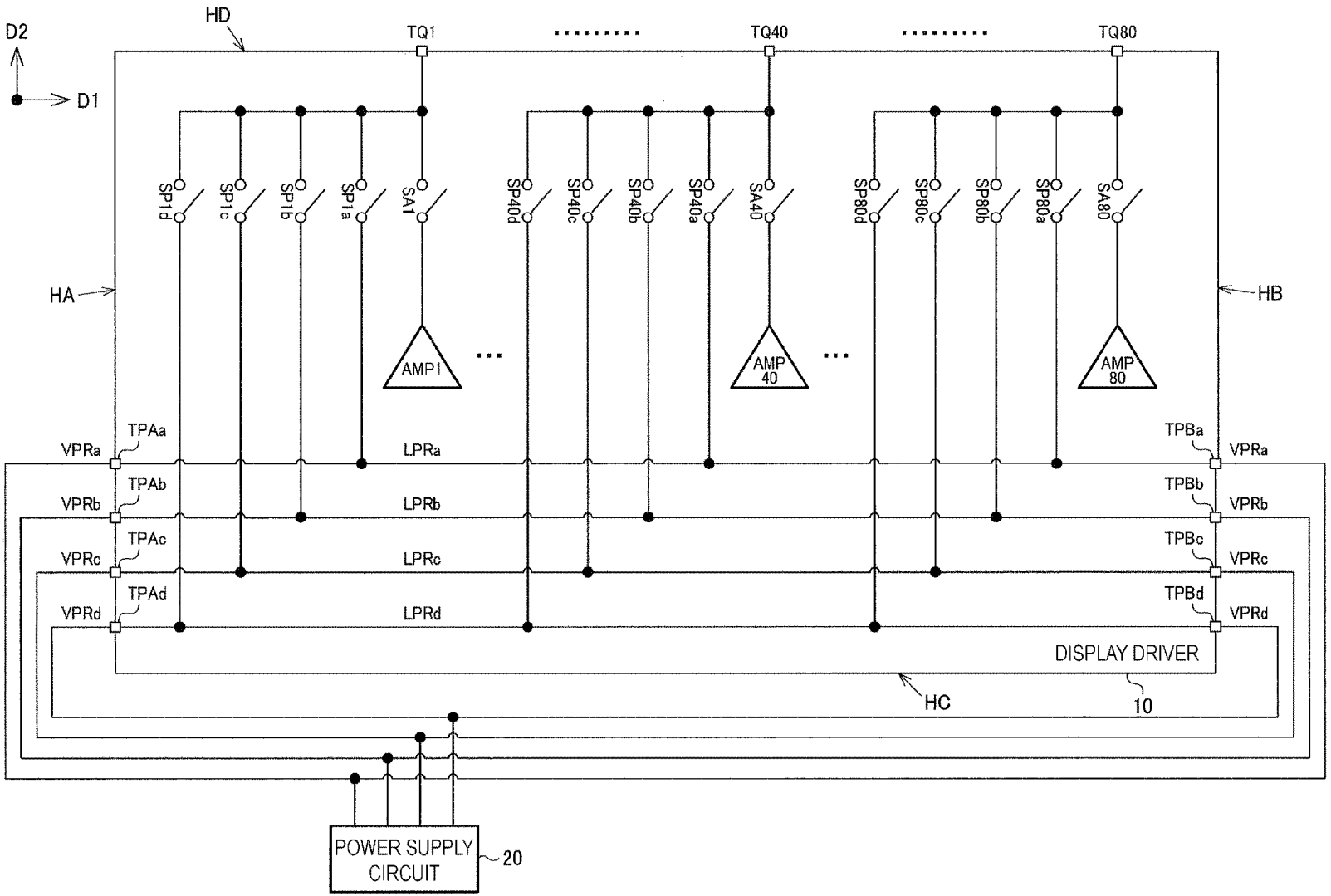
FIG. 1 illustrates a first configuration example of a display driver according to one exemplary embodiment.

FIG. 1 illustrates a first configuration example of a display driver according to one exemplary embodiment. A display driver 10 includes amplifier circuits AMP1 to AMP80 and amplifier switching elements SA1 to SA80 (switches or amplifier switches). The display driver 10 further includes precharge lines LPRa to LPRd, precharge line switching elements SP1*a* to SP80*a*, SP1*b* to SP80*b*, SP1*c* to SP80*c*, and SP1*d* to SP80*d* (switches or precharge line switches), data voltage output terminals TQ1 to TQ80, and precharge terminals TPAa to TPAd and TPBa to TPBd. The configuration of the display driver is not limited to the configuration illustrated in FIG. 1, and various modifications are available. For example, a part of the components may be partially omitted, or another component may be added. In the description below, four precharge voltages are supplied using four precharge lines. However, the disclosure is not limited to this. For example, m (m is an integer greater than or equal to 1) precharge voltages may be supplied using m precharge lines. Moreover, in the example below, the display driver 10 includes 80 amplifier circuits. However, the disclosure is not limited to this. The display driver 10 may include n (n is an integer greater than or equal to 2) amplifier circuits.

The display driver 10 may be, for example, an integrated circuit unit (semiconductor circuit device). The data voltage output terminals TQ1 to TQ80 (TQ1 to TQn) and the precharge terminals TPAa to TPAd and TPBa to TPBd are, for example, pads formed on a semiconductor substrate (semiconductor chip) or terminals of a package of the integrated circuit unit.

The amplifier circuits AMP1 to AMP80 (AMP1 to AMPn) perform display driving and precharge an electro-optic panel (display panel). That is, the amplifier circuit AMP1 outputs a gray scale voltage and a precharge voltage to a data line (pixel) of the electro-optic panel via the data voltage output terminal TQ1. Similarly, the amplifier circuits AMP2 to AMP80 output a gray scale voltage and a precharge voltage to a data line of the electro-optic panel via the respective data voltage output terminals TQ2 to TQ80. The precharge voltages output from the amplifier circuits AMP1 to AMP80 are each referred to as an "amplifier precharge voltage". As described below, the amplifier circuits AMP1 to AMP80 may partially output the amplifier precharge voltages. The amplifier circuits AMP1 to AMP80 may have various configurations. Each of the amplifier circuits AMP1 to AMP80 may be, for example, an operational amplifier configured as a voltage follower, or may be a non-inverting amplifier circuit or an inverting amplifier circuit including an operational amplifier and a feedback circuit (including, for example, a resistor, a capacitor, or both).

A first end of the precharge line LPRa is coupled with the precharge terminal TPAa, and a second end is coupled with the precharge terminal TPBa. A precharge line voltage VPRa is supplied from a power supply circuit 20 to the precharge line LPRa via the precharge terminals TPAa and TPBa. Similarly, first ends of the precharge lines LPRb to LPRd are respectively coupled with the precharge terminals TPAb to TPAd. Second ends are respectively coupled with the precharge terminals TPBb to TPBd. Precharge line voltages VPRb to VPRd are respectively supplied from the power supply circuit 20 to the precharge lines LPRb to LPRd via the precharge terminals TPAb to TPAd and the precharge terminals TPBb to TPBd. The precharge voltages supplied to the precharge lines LPRa to LPRd are referred to as "precharge line voltages". The precharge lines LPRa to LPRd are, for example, metal layer wiring lines (for example, aluminum wiring lines) formed on a semiconductor substrate, and laid in a direction D1 along the long sides of the display driver 10. In FIG. 1, the precharge terminals TPAa to TPAd are disposed on a short side HA of the display driver 10, and the precharge terminals TPBa to TPBd are disposed on a short side HB of the display driver 10. However, the disclosure is not limited to this. For example, the display driver 10 may have either the precharge terminals TPAa to TPAd or the precharge terminals TPBa to TPBd. In addition, the precharge terminals TPAa to TPAd may be disposed on a long side HC adjacent to a first end of the long side HC (adjacent to the short side HA), and the precharge terminals TPBa to TPBd may be disposed on the long side HC adjacent to a second end of the long side HC (adjacent to the short side HB). The long side HC is a side facing a long side HD, on which the data voltage output terminals TQ1 to TQ80 are disposed. The precharge lines LPRa to LPRd laid in the direction D1 may be respectively coupled with the precharge terminals TPAa to TPAd and the precharge terminals TPBa to TPBd by wiring lines laid in a direction D2 (direction orthogonal to the direction D1) along the short sides of the display device 10.

The power supply circuit 20 is disposed outside the display driver 10, and generates the precharge line voltages VPRa to VPRd. For example, the power supply circuit 20 is a regulator (for example, a linear regulator or a switching regulator) that generates the precharge line voltages VPRa to VPRd by stepping up or stepping down the source voltage supplied from outside the power supply circuit 20. In FIG. 1, the precharge line voltages VPRa to VPRd are supplied from outside the display driver 10. However, the disclosure is not limited to this. For example, the display driver may include a power supply circuit that generates the precharge line voltages VPRa to VPRd. In this case, the precharge terminals TPAa to TPAd and TPBa to TPBd are omitted, and the precharge lines LPRa to LPRd are coupled with output nodes of the power supply circuit.

The amplifier switching element SA1 is disposed between the amplifier circuit AMP1 and the data voltage output terminal TQ1. Specifically, a first end of the amplifier switching element SA1 is coupled with the output of the amplifier circuit AMP1, and a second end is coupled with the data voltage output terminal TQ1. Similarly, the amplifier switching elements SA2 to SA80 (SA2 to SAn) are respectively disposed between the outputs of the amplifier circuits AMP2 to AMP80 and the data voltage output terminals TQ2 to TQ80. Specifically, first ends of the amplifier switching elements SA2 to SA80 are respectively coupled with the outputs of the amplifier circuits AMP2 to AMP80, and second ends are respectively coupled with the data voltage output terminals TQ2 to TQ80. For example, the amplifier switching elements SA1 to SA80 include one or more transistors.

The precharge line switching element SP1*a* is disposed between the precharge line LPRa and the data voltage output terminal TQ1. Specifically, a first end of the precharge line switching element SP1*a* is coupled with the precharge line LPRa, and a second end is coupled with the data voltage output terminal TQ1. Similarly, the precharge line switching elements SP2*a* to SP80*a* (SP2*a* to SPna) are respectively disposed between the precharge line LPRa and the data voltage output terminals TQ2 to TQ80. Specifically, first ends of the precharge line switching elements SP2*a* to SP80*a* are coupled with the precharge line LPRa, and second ends are respectively coupled with the data voltage output terminals TQ2 to TQ80. Similarly, the precharge line switching elements SP1*b* to SP80*b* (SP1*b* to SPnb) are respectively disposed between the precharge line LPRb and the data voltage output terminals TQ1 to TQ80. Specifically, first ends of the precharge line switching element SP1*b* to SP80*b* are coupled with the precharge line LPRb, and second ends are respectively coupled with the data voltage output terminals TQ1 to TQ80. The precharge line switching elements SP1*c* to SP80*c* (SP1*c* to SPnc) are respectively disposed between the precharge line LPRc and the data voltage output terminals TQ1 to TQ80. Specifically, first ends of the precharge line switching elements SP1*c* to SP80*c* are coupled with the precharge line LPRc, and second ends are respectively coupled with the data voltage output terminals TQ1 to TQ80. The precharge line switching elements SP1*d* to SP80*d* (SP1*d* to SPnd) are respectively disposed between the precharge line LPRd and the data voltage output terminals TQ1 to TQ80. Specifically, first ends of the precharge line switching elements SP1*d* to SP80*d* are coupled with the precharge line LPRd, and second ends are respectively coupled with the data voltage output terminals TQ1 to TQ80. For example, the precharge line switching elements SP1*a* to SP80*a*, SP1*b* to SP80*b*, SP1*c* to SP80*c*, and SP1*d* to SP80*d* include one or more transistors.

Figure 2:
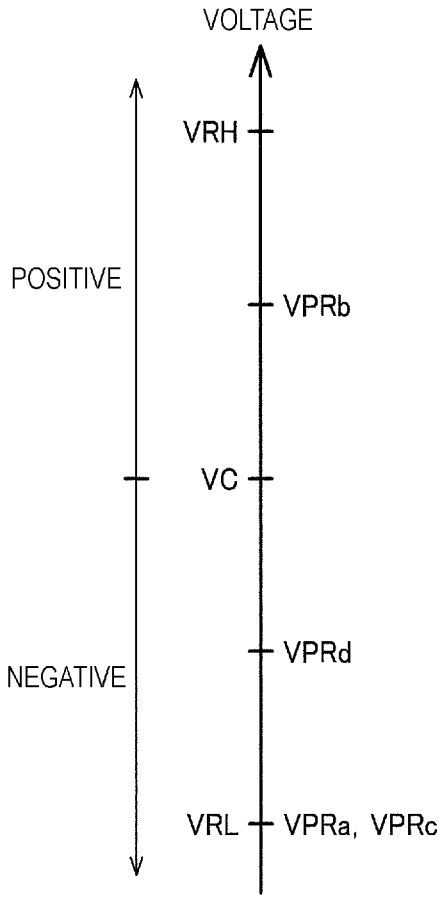
FIG. 2 illustrates an example of precharge voltages according to one exemplary embodiment.

FIG. 2 illustrates an example of precharge voltages according to one exemplary embodiment. In one exemplary embodiment, frame inversion driving in which positive driving and negative driving alternate each frame (vertical scanning period) is performed. Pixels are driven by positive data voltages in positive driving, and driven by negative data voltages in negative driving. Note that the disclosure is not limited to this. Line inversion driving in which positive driving and negative driving alternate each line (horizontal scanning period) or dot inversion driving in which positive driving and negative driving alternate each dot (pixel) may also be used.

As illustrated in FIG. 2, voltages lower than a common voltage VC are defined as negative voltages, and voltages higher than the common voltage VC are defined as positive voltages. The negative gray scale voltages (data voltages) range from VC to VRL, and the positive gray scale voltages (data voltages) range from VC to VRH, where VRL<VC<VRH.

The precharge line voltages VPRa and VPRb are used for precharging in positive driving. The precharge line voltage VPRa is a negative voltage, and the precharge line voltage VPRb is a positive voltage. The precharge line voltages VPRc and VPRd are used for precharging in negative driving. Specifically, the precharge line voltage VPRb is a voltage between the common voltage VC and the voltage VRH, and is, for example, a voltage adjacent to the midpoint between the common voltage VC and the voltage VRH (for example, VC+(VRH−VC)×¼ to VC+(VRH−VC)×¾). The precharge line voltage VPRd is a voltage between the common voltage VC and the voltage VRL, and is, for example, a voltage adjacent to the midpoint between the common voltage VC and the voltage VRL (for example, VC+(VRL−VC)×¼ to VC+(VRL−VC)×¾), where VPRa<VPRd and VPRc<VPRd, and, for example, VPRa=VPRc=VRL. The precharge line voltages VPRa and VPRc may be different from the voltage VRL, and the precharge line voltages VPRa and VPRc may be different from each other.

Figure 3:
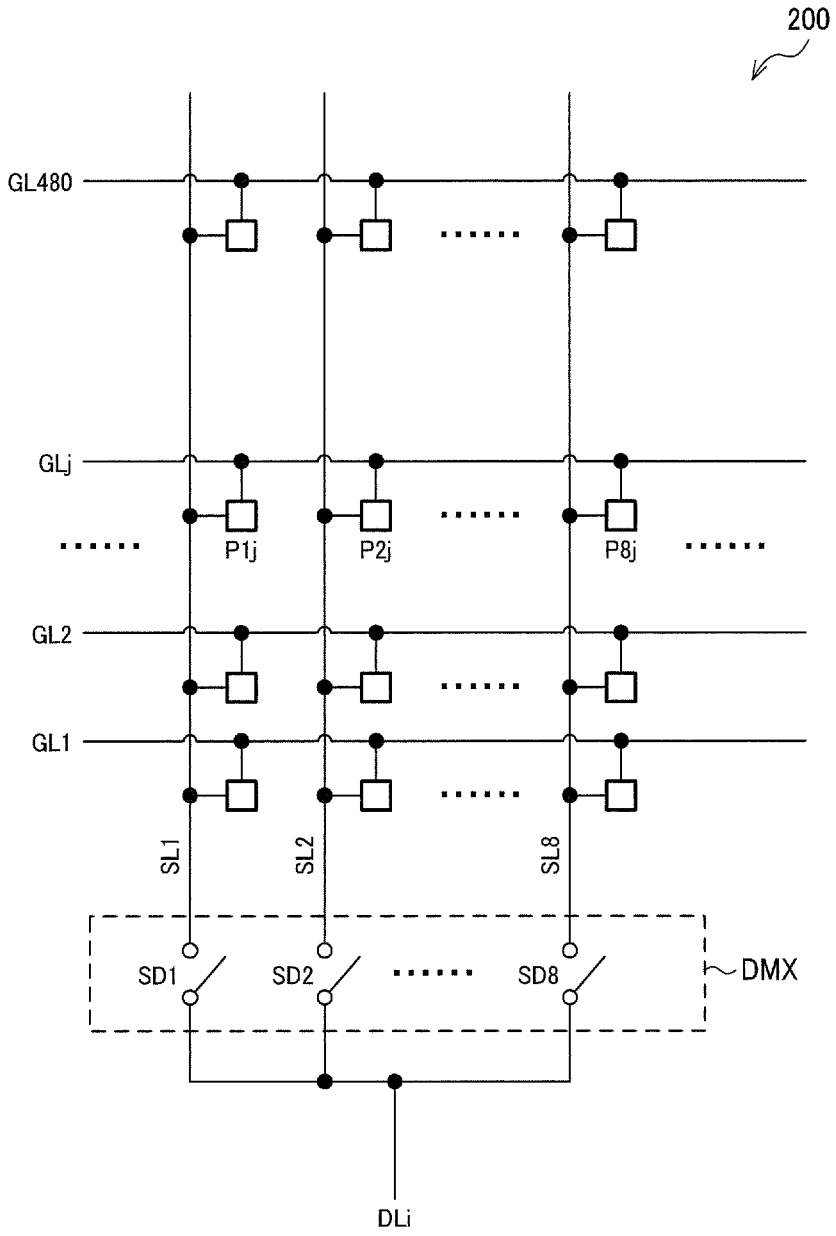
FIG. 3 illustrates a configuration example of an electro-optic panel driven by the display driver according to one exemplary embodiment.

FIG. 3 illustrates a configuration example of an electro-optic panel driven by the display driver according to one exemplary embodiment. FIG. 3 illustrates a part of a pixel array of 640×480 relating to a data line DLi coupled with a data voltage output terminal TQi in the display driver 10, where i is an integer in the range of 1≤i≤80. An example of multiplex driving of which number of multiplexing is eight is described below. However, the disclosure is not limited to the case where the number of multiplexing (the number of pixels driven by one amplifier circuit in one horizontal scanning period) is eight. Moreover, the size of the pixel array is not limited to 640×480.

An electro-optic panel 200 includes the data line DLi, source lines SL1 to SL8, a demultiplexer DMX, gate lines GL1 to GL480 (scanning lines), and 8×480 pixel circuits.

The demultiplexer DMX includes switching elements SD1 to SD8. The switching element SD1 is disposed between the data line DLi and the source line SL1. Similarly, the switching elements SD2 to SD8 are respectively disposed between the data line DLi and the source lines SL2 to SL8. For example, the switching elements SD1 to SD8 are Thin Film Transistors (TFTs). Taking a gate line GLj as an example, where j is an integer in the range of 1≤j≤480, a pixel circuit P1*j* is coupled with the gate line GLj and the source line SL1. Similarly, the pixel circuits P2*j* to P8*j* are respectively coupled with the gate line GLj and the source lines SL2 to SL8. Each pixel circuit includes, for example, a liquid crystal cell (pixel) and a transistor (TFT). The source of the TFT is coupled with the source line, the drain is coupled with the liquid crystal cell, and the gate is couple with the gate line.

Figure 4:
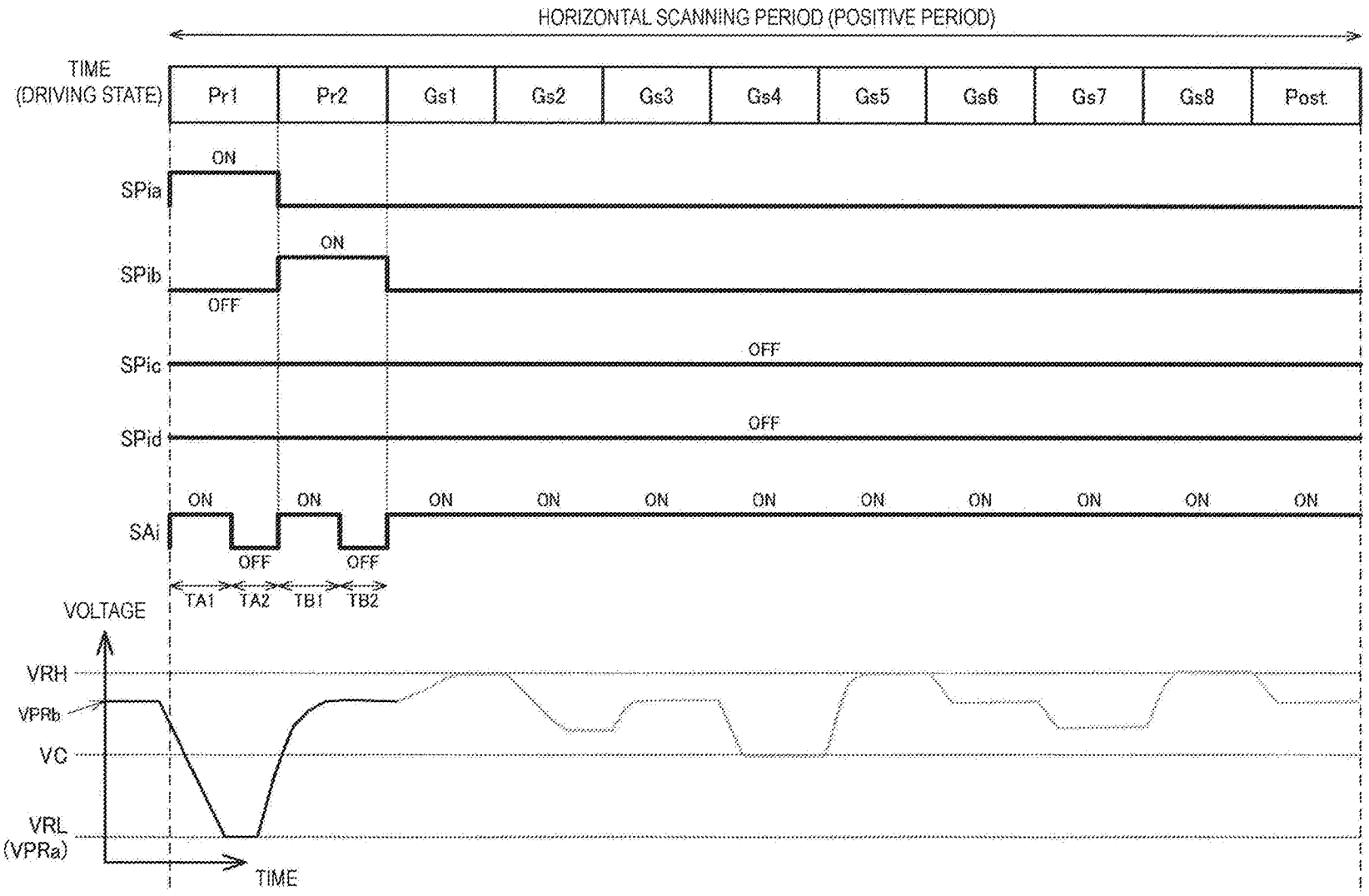
FIG. 4 illustrates operations of the display driver according to one exemplary embodiment.
Figure 5:
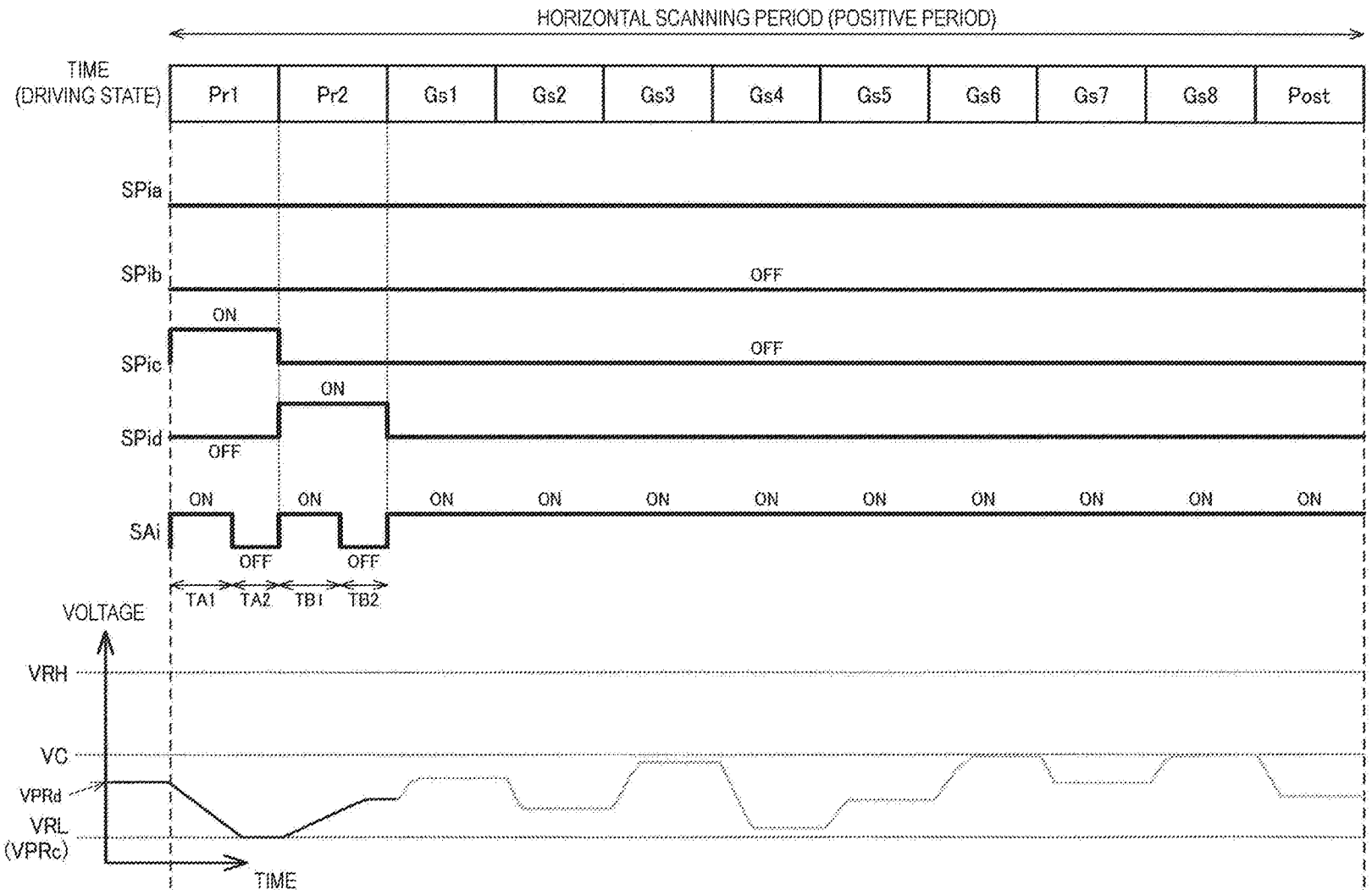
FIG. 5 illustrates operations of the display driver according to one exemplary embodiment.

Operations of the display driver according to one exemplary embodiment will now be described by taking a case where the electro-optic panel illustrated in FIG. 3 is driven as an example. FIGS. 4 and 5 illustrate the operations of the display driver according to one exemplary embodiment. FIG. 4 is a timing chart during one horizontal scanning period in a positive period. FIG. 5 is a timing chart during one horizontal scanning period in a negative period. The positive period is a period in which positive driving is performed on pixels, and the negative period is a period in which negative driving is performed on the pixels. For example, in a case where frame inversion driving is performed, each of the positive period and the negative period corresponds to one frame (one vertical scanning period). In the description below, i is an integer in the range of 1≤i≤80, and the switching elements are expressed as SPia, SPib, SPic, SPid, and SAi as appropriate.

As illustrated in FIG. 4, precharge periods Pr1 and Pr2 precede drive times Gs1 to Gs8 during which the pixels are driven in the horizontal scanning period. During the precharge period Pr1, precharging is performed to improve image quality (for example, reduction in vertical crosstalk). During the precharge period Pr2, precharging is performed to supplement in driving of the pixels (for example, to reduce insufficient writing). The precharge period Pr2 follows the precharge period Pr1 (subsequent to Pr1), and has a length different from the length of the precharge period Pr1. The precharge periods Pr1 and Pr2 may not be consecutive. Moreover, the lengths of the precharge periods Pr1 and Pr2 may be identical.

During the precharge period Pr1 in the horizontal scanning period of the positive period, the precharge line switching element SPia is turned on, and the precharge line switching elements SPib, SPic, and SPid are turned off. Thus, the precharge line voltage VPRa is supplied to the data line DLi. For example, assume that the gate line GLj (pixel circuits P1*j* to P8*j*) in FIG. 3 is selected during the horizontal scanning period in FIG. 4. During the precharge period Pr1, the switching elements SD1 to SD8 of the demultiplexer DMX are turned on, and the precharge line voltage VPRa is applied to the pixels of the pixel circuits P1*j* to P8*j*.

The precharge period Pr1 is divided into a term TA1 and a term TA2 subsequent to the term TA1 (following the term TA1). During the term TA1, the amplifier switching element SAi is also turned on, and the amplifier circuit AMPi applies the amplifier precharge voltage (for example, a voltage identical to VPRa) to the pixels of the pixel circuits P1*j* to P8*j*. That is, during the term TA1, the pixels of the pixel circuits P1*j* to P8*j* are precharged using the precharge line voltage VPRa from the power supply circuit 20 and the amplifier precharge voltage from the amplifier circuit AMPi. During the term TA2, the amplifier switching element SAi is turned off, and the pixels of the pixel circuits P1*j* to P8*j* are precharged using the precharge line voltage VPRa from the power supply circuit 20.

During the precharge period Pr2, the precharge line switching element SPib is turned on, and the precharge line switching elements SPia, SPic, and SPid are turned off. Thus, the precharge line voltage VPRb is supplied to the data line DLi. At this point, the switching elements SD1 to SD8 of the demultiplexer DMX are turned on, and the precharge line voltage VPRb is applied to the pixels of the pixel circuits P1*j* to P8*j*.

The precharge period Pr2 is divided into a term TB1 and a term TB2 subsequent to the term TB1 (following the term TB1). During the term TB1, the amplifier switching element SAi is turned on, and the amplifier circuit AMPi applies the amplifier precharge voltage (for example, a voltage identical to VPRb) to the pixels of the pixel circuits P1*j* to P8*j*. That is, during the term TB1, the pixels of the pixel circuits P1*j* to P8*j* are precharged using the precharge line voltage VPRb from the power supply circuit 20 and the amplifier precharge voltage from the amplifier circuit AMPi. During the term TB2, the amplifier switching element SAi is turned off, and the pixels of the pixel circuits P1*j* to P8*j* are precharged using the precharge line voltage VPRb from the power supply circuit 20.

During the drive times Gs1 to Gs8, the precharge line switching elements SPia to SPid are turned off, and the amplifier switching element SAi is turned on. During the drive time Gs1, the switching element SD1 of the demultiplexer DMX is turned on, the switching elements SD2 to SD8 are turned off. Thus, the amplifier circuit AMPi writes the gray scale voltage into the pixel circuit P1*j*. Similarly, during the drive times Gs2 to Gs8, the switching elements SD2 to SD8 of the demultiplexer DMX are respectively turned on, and the amplifier circuit AMPi respectively writes the gray scale voltage into the pixel circuits P2*j* to P8*j*.

A postcharge time Post follows the drive times Gs1 to Gs8. During the postcharge time Post, the precharge line switching elements SPia to SPid are turned off. Thus, the precharge line voltage VPRa is supplied to the data line DLi. At this point, the switching elements SD1 to SD8 of the demultiplexer DMX are turned on, and the precharge line voltage VPRa is applied to the source lines SL1 to SL8.

As illustrated in FIG. 5, during the precharge period Pr1 in the horizontal scanning period of the negative period, the precharge line switching element SPic is turned on, and the precharge line switching elements SPia, SPib, and SPid are turned off. Thus, the precharge line voltage VPRc is supplied to the data line DLi. At this point, the switching elements SD1 to SD8 of the demultiplexer DMX are turned on, and the precharge line voltage VPRc is applied to the pixels of the pixel circuits P1*j* to P8*j*. The precharge period Pr1 is divided into the terms TA1 and TA2 as in the positive period. During the term TA1, the pixels of the pixel circuits P1*j* to P8*j* are precharged using the precharge line voltage VPRc from the power supply circuit 20 and the amplifier precharge voltage (for example, a voltage identical to VPRc) from the amplifier circuit AMPi.

During the precharge period Pr2, the precharge line switching element SPid is turned on, and the precharge line switching elements SPia to SPic are turned off. Thus, the precharge line voltage VPRd is supplied to the data line DLi. At this point, the switching elements SD1 to SD8 of the demultiplexer DMX are turned on, and the precharge line voltage VPRd is applied to the pixels of the pixel circuits P1*j* to P8*j*. The precharge period Pr2 is divided into the terms TB1 and TB2 as in the positive period. During the term TB1, the pixels of the pixel circuits P1*j* to P8*j* are precharged using the precharge line voltage VPRd from the power supply circuit 20 and the amplifier precharge voltage (for example, a voltage identical to VPRd) from the amplifier circuit AMPi.

In a manner similar to the operations during the drive times Gs1 to Gs8 in the positive period, the negative gray scale voltage is written into the pixels of the pixel circuits P1*j* to P8*j*. During the postcharge time Post, the precharge line switching element SPia to SPid are turned off. The switching elements SD1 to SD8 of the demultiplexer DMX are turned on, and the precharge line voltage VPRc is applied to the source lines SL1 to SL8.

Figure 6:
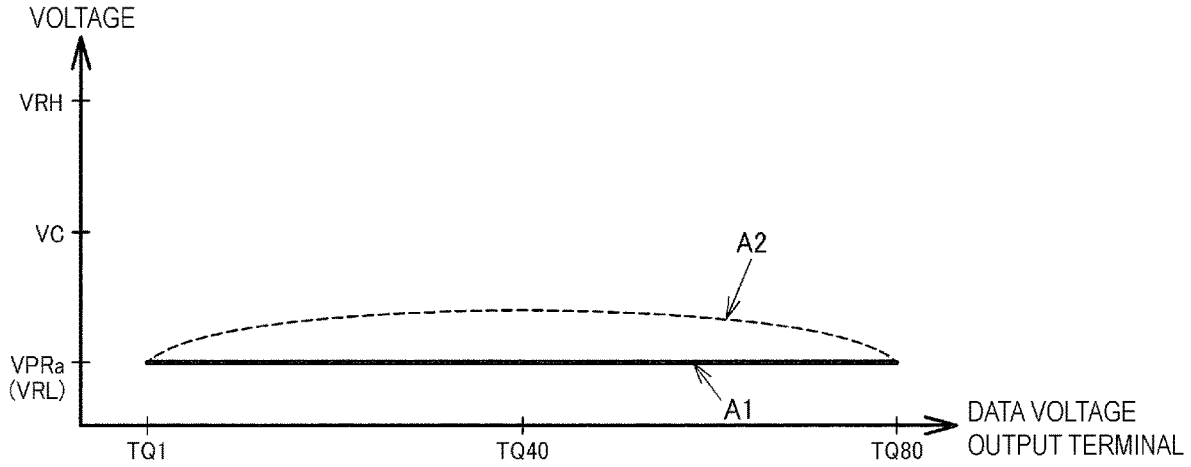
FIG. 6 illustrates characteristics of the voltages at data voltage output terminals when a precharge period ends.

FIG. 6 illustrates characteristics of the voltages at the data voltage output terminals (data lines) when a precharge period ends. FIG. 6 illustrates the voltages at the end of the precharge period Pr1 in the positive period as an example. However, the voltages exhibit similar characteristics also at the ends of the precharge period Pr2 in the positive period and the precharge periods Pr1 and Pr2 in the negative period.

The precharge line voltage VPRa is supplied from the power supply circuit 20 to the precharge line LPRa via the precharge terminals TPAa to TPBa, and then supplied from the precharge line LPRa to the data voltage output terminals TQ1 to TQ80. As the wiring line lengths from the precharge terminals TPAa and TPBa (short sides HA and HB) to the data voltage output terminals become longer, the parasitic resistances or the parasitic capacitances in the wiring line increase, and the times to charge the data lines, the source lines, and the pixels increase. Thus, as indicated by A2 in FIG. 6, the farther the data voltage output terminals are located from the precharge terminals TPAa and TPBa, the larger the differences between the voltages reached during the precharge period Pr1 and the precharge line voltage VPRa may become. For example, in a case where the precharge period Pr1 is reduced due to, for example, an increase in the number of pixels of the electro-optic panel, the effect may be more remarkable.

In one exemplary embodiment, the amplifier switching element SAi is turned on during the term TA1 of the precharge period Pr1, and the amplifier precharge voltage is supplied from the amplifier circuit AMPi to the data line. The amplifier circuit AMPi corresponds to the data voltage output terminal TQi, and precharges the data line (pixels) without any effects of the distances from the precharge terminals TPAa and TPBa. Thus, as indicated by A1 in FIG. 6, the differences between the voltages reached for the precharge period Pr1 and the precharge line voltage VPRa are reduced.

The example of multiplex driving has been described above. However, the application of the disclosure is not limited to multiplex driving. For example, the disclosure is applicable to phase development driving. In the phase development driving, a predetermined number of consecutive source lines (data lines) are defined as one block, and a plurality of blocks are driven one block after another in a time division manner during a horizontal scanning period. For example, in a case where there are 640 source lines and eight source lines constitute one block, the display driver includes eight amplifier circuits, and drives the first to eighth source lines, the ninth to sixteenth source lines, . . . , and the 633th to 640th source lines in sequence during a horizontal scanning period. In such phase development driving, the horizontal scanning period includes the precharge periods Pr1 and Pr2 at, for example, the leading part of the horizontal scanning period. During the precharge periods Pr1 and Pr2, the switching elements (TFTs) that select the source lines are turned on, and the pixels for one line coupled with the selected gate line are precharged.

In the foregoing, one horizontal scanning period includes two precharge periods. However, the disclosure is not limited to this. For example, one horizontal scanning period may include one precharge period (for example, Pr1 or Pr2). Moreover, precharge periods may be provided for each set of a plurality of horizontal scanning periods, and some of the plurality of horizontal scanning periods may not include any precharge periods.

According to some exemplary embodiments described above, the display driver 10 includes a first data voltage output terminal (for example, TQ40), a first amplifier circuit (AMP40), a first precharge line (for example, LPRa), a first amplifier switching element (SA40), and a first precharge line switching element (SP40*a*). The first amplifier circuit (AMP40) outputs a gray scale voltage during drive times (Gs1 to Gs8), and outputs a first amplifier precharge voltage during a first precharge period (for example, Pr1). The first precharge line (LPRa) supplies a first precharge line voltage (VPRa). The first amplifier switching element (SA40) is disposed between the first amplifier circuit (AMP40) and the first data voltage output terminal (TQ40). The first precharge line switching element (SP40*a*) is disposed between the first precharge line (LPRa) and the first data voltage output terminal (TQ40).

The first data voltage output terminal, the first amplifier circuit, the first amplifier switching element, and the first precharge line switching element are not limited to the example above, and may be TQi, AMPi, SAi, and SPia, where i is an integer in the range of $1 \leq i \leq 80$. Moreover, the first precharge line is not limited to LPRa, and may be LPRb, LPRc, or LPRd. Furthermore, the first precharge period is not limited to Pr1, and may be Pr2.

According to one exemplary embodiment, insufficiency of speed of writing the precharge voltage is rectified. Specifically, as illustrated with reference to FIG. 6, variations in precharging speed in the lateral direction (at the ends and the center) of the electro-optic panel are reduced by combining precharging from the precharge lines and precharging from the amplifier circuits (video amplifiers).

Figure 7:
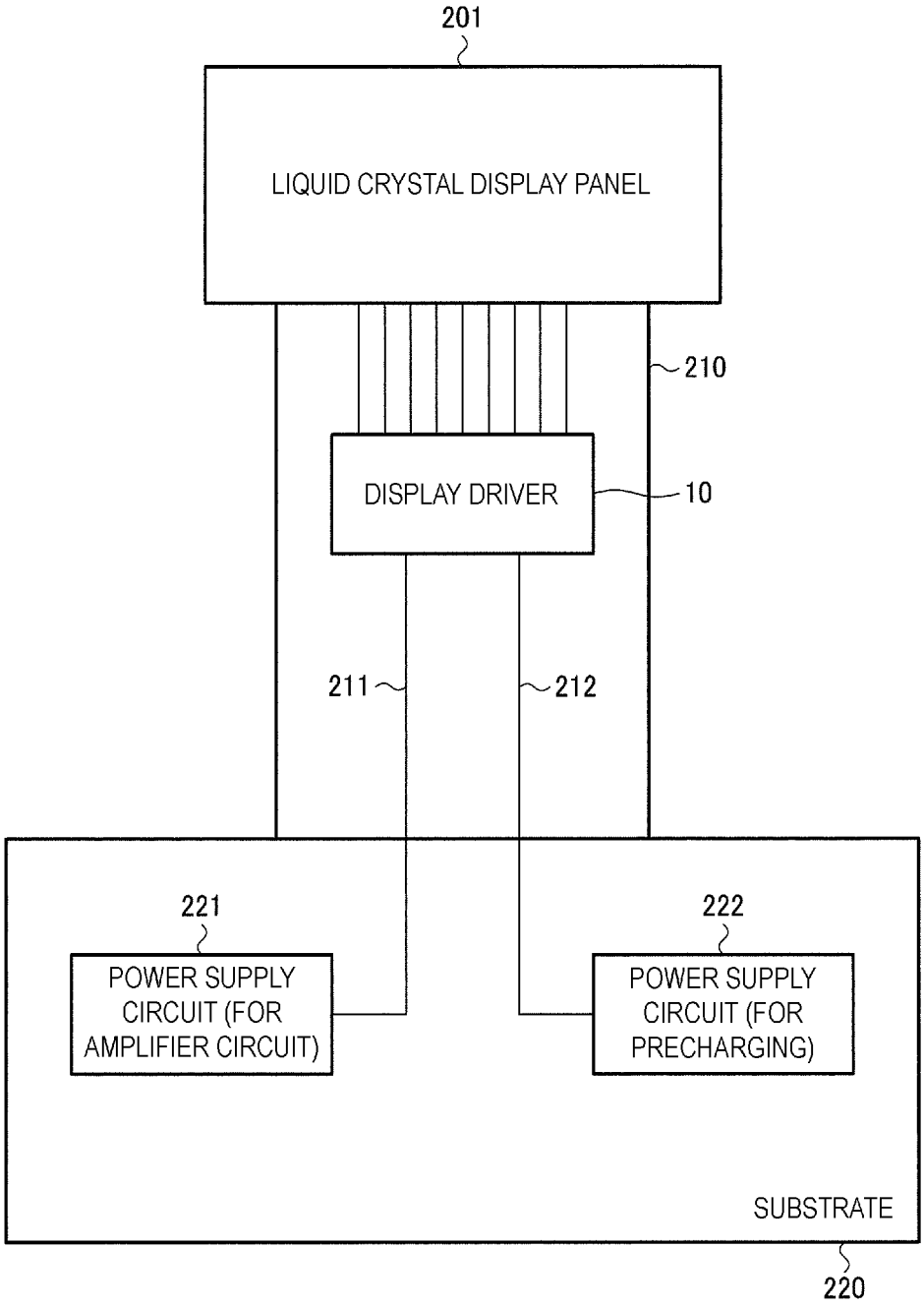
FIG. 7 illustrates current flowing in a power supply circuit during precharging.

Moreover, the display driver 10 is less likely to malfunction by combining precharging from the precharge lines and precharging from the amplifier circuits (video amplifiers). Specifically, as illustrated in FIG. 7, a liquid crystal display panel 201 and a substrate 220 (for example, printed circuit board) are coupled by a flexible substrate 210. The display driver 10 is mounted on the flexible substrate 210, and power supply circuits 221 and 222 (power supply circuit ICs) are mounted on the substrate 220. The power supply circuit 221 supplies power to the amplifier circuits AMP1 to AMP80 of the display driver 10 via a wiring line 211. The power supply circuit 222 corresponds to the power supply circuit 20 in FIG. 1, and supplies the precharge line voltages VPRa to VPRd to the precharge terminals TPAa to TPAd and TPBa to TPBd of the display driver 10 via a wiring line 212. At this moment, current (electrical charges) to precharge the liquid crystal display panel 201 is allocated between the wiring lines 211 and 212. For example, the current flowing in the wiring line 211 becomes smaller than a case where, for example, precharging is performed using the amplifier circuits AMP1 to AMP80 without using the power supply circuit 222, and a drop in source voltage supplied to the amplifier circuits AMP1 to AMP80 is made smaller. Such a drop in the source voltage during precharging propagates as noise via, for example, the substrate (semiconductor substrate) of the display driver 10, and may cause malfunctions of interface circuits, logic circuits, and other circuits. However, the malfunctions are less likely to occur in one exemplary embodiment.

Figure 8:
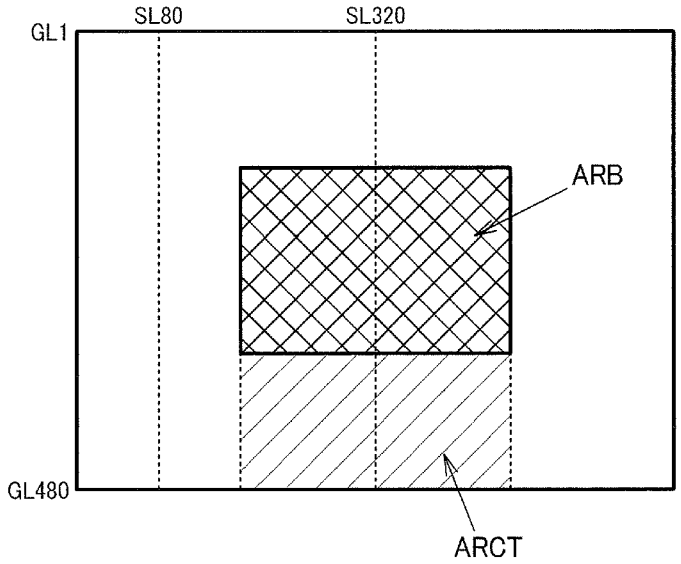
FIG. 8 illustrates vertical crosstalk.

The variations in precharging speed in the lateral direction of the electro-optic panel are reduced as described above, and thus the effects of supplementary writing and image quality improvement by precharging are enhanced. That is, precharging for supplementary writing reduces the differences between the gray scale voltage to be written into the pixels and the gray scale voltages actually written into the pixels. However, in the case where the precharging speed varies as indicated by A2 in FIG. 6, the effect of supplementary writing may vary in the lateral direction (at the ends and the center) of the electro-optic panel. These variations are reduced in one exemplary embodiment. Moreover, precharging for image quality improvement reduces, for example, vertical crosstalk in frame inversion driving. In a case where there is a black region ARB in a white screen as illustrated in FIG. 8, the color of a region ARCT below (in the vertical scanning direction) the black region ARB is different from the white color of the surrounding region (for example, white with lower brightness than the white color of the surrounding region). This vertical crosstalk occurs because the amount of electrical charges of off-state leakage current from the pixels via the TFTs differs between at the source lines passing the white region (for example, SL80) and at the source lines passing the black region ARB (for example, SL320). Precharging for image quality improvement resets the effect of such leakage (removes the electrical charges in the pixels) to reduce the vertical crosstalk. However, in the case where the precharging speed varies as indicated by A2 in FIG. 6, the effect of reducing the vertical crosstalk may vary in the lateral direction (at the ends and the center) of the electro-optic panel. These variations are reduced in one exemplary embodiment.

Moreover, in one exemplary embodiment, the first amplifier switching element (for example, SA40) and the first precharge line switching element (for example, SP40*a*) are turned on during a first period (for example, TA1) of the first precharge period (for example, Pr1). During a second period (TA2) of the first precharge period (Pr1) subsequent to the first period (TA1), the first amplifier switching element (SA40) is turned off, while the first precharge line switching element (SP40*a*) is turned on.

Thus, the electro-optic panel is rapidly precharged using both the precharge line voltage and the amplifier precharge voltage during the first period. In addition, the amplifier circuit can prepare to output the next voltage during the second period. For example, as illustrated in FIG. 4, the amplifier circuit outputs VPRa during the term TA1 of the precharge period Pr1, and outputs VPRb during the precharge period Pr2. The voltages VPRa and VPRb are supplied from, for example, a digital-to-analog (D/A) converter circuit 120 in FIG. 15. In a case where the timing of switching the amplifier precharge voltage and the timing of switching the precharge line switching elements SPia and SPib are shifted, the amplifier precharge voltage and the precharge line voltage differ from each other. In one exemplary embodiment, the voltage output from the D/A converter circuit 120 is switched to VPRb during the term TA2 of the precharge period Pr1, and thus the amplifier precharge voltage and the precharge line voltage do not differ from each other.

In one exemplary embodiment, the display driver 10 further includes a first precharge terminal (TPAa or TPAb) that supplies the first precharge line voltage (VPRa) to the first precharge line (for example, LPRa) from outside the display driver 10 (for example, the power supply circuit 20).

This enables precharging using a power supply circuit with high current (electrical charge) supply capability compared with a case where the precharge line voltage is supplied from the power supply circuit embedded in the display driver 10. In the case where the precharge line voltage is supplied from the power supply circuit embedded in the display driver 10, noise may occur during precharging, and may cause malfunctions of, for example, the display driver 10. However, such malfunctions are avoided by supplying the precharge line voltage from outside.

In one exemplary embodiment, the display driver 10 further includes a second precharge line (LPRb) and a second precharge line switching element (SP40*b*). The second precharge line (LPRb) supplies a second precharge line voltage (for example, VPRb). The second precharge line switching element (SP40*b*) is disposed between the second precharge line (LPRb) and the first data voltage output terminal (for example, TQ40). The second precharge line voltage differs from the first precharge line voltage.

Thus, the electro-optic panel is precharged using the first precharge line voltage and the second precharge line voltage. For example, precharging for image quality improvement is performed using the first precharge line voltage, and precharging for supplementary writing is performed using the second precharge line voltage.

Moreover, in one exemplary embodiment, the first precharge line voltage (VPRa) is a negative voltage with respect to a common voltage VC. The second precharge line voltage (VPRb) is a positive voltage with respect to the common voltage VC. The first precharge line switching element (for example, SP40*a*) is turned on during the first precharge period (Pr1) in a positive period. The second precharge line switching element (SP40*b*) is turned on during a second precharge period (Pr2) subsequent to the first precharge period (Pr1) in the positive period.

Thus, the first precharge line voltage is supplied from the first precharge line to the first data voltage output terminal via the first precharge line switching element during the first precharge period. Moreover, the second precharge line voltage is supplied from the second precharge line to the first data voltage output terminal via the second precharge line switching element during the second precharge period. In this manner, two steps of precharging are performed during the horizontal scanning period. The first precharge line voltage that is negative with respect to the common voltage VC enables, for example, precharging for image quality improvement. Moreover, the second precharge line voltage that is positive with respect to the common voltage VC enables, for example, precharging for supplementary writing in positive driving.

In one exemplary embodiment, the display driver 10 further includes a third precharge line (LPRc) and a fourth precharge line (LPRd). The third precharge line (LPRc) supplies a third precharge line voltage (VPRc). The fourth precharge line (LPRd) supplies a fourth precharge line voltage (VPRd). The display driver 10 further includes a third precharge line switching element (SP40*c*) and a fourth precharge line switching element (SP40*d*). The third precharge line switching element (SP40*c*) is disposed between the third precharge line (LPRc) and the first data voltage output terminal (for example, TQ40). The fourth precharge line switching element (SP40*d*) is disposed between the fourth precharge line (LPRd) and the first data voltage output terminal (TQ40).

Thus, the electro-optic panel is precharged using the third precharge line voltage and the fourth precharge line voltage. For example, precharging is performed using the first precharge line voltage and the second precharge line voltage in the positive period and using the third precharge line voltage and the fourth precharge line voltage in a negative period. Moreover, precharging for image quality improvement is performed using the third precharge line voltage, and precharging for supplementary writing in negative driving is performed using the fourth precharge line voltage.

Moreover, in one exemplary embodiment, the third precharge line voltage (VPRc) is a negative voltage with respect to the common voltage VC, and the fourth precharge line voltage (VPRd) is a negative voltage with respect to the common voltage VC and higher than the third precharge line voltage (VPRc). The third precharge line switching element (for example, SP40*c*) is turned on during the first precharge period (Pr1) in the negative period, and the fourth precharge line switching element (SP40*d*) is turned on during the second precharge period (Pr2) in the negative period.

Thus, the third precharge line voltage is supplied from the third precharge line to the first data voltage output terminal via the third precharge line switching element during the first precharge period. Moreover, the fourth precharge line voltage is supplied from the fourth precharge line to the first data voltage output terminal via the fourth precharge line switching element during the second precharge period. In this manner, two steps of precharging are performed during the horizontal scanning period. The third precharge line voltage that is negative with respect to the common voltage VC enables, for example, precharging for image quality improvement. Moreover, the fourth precharge line voltage that is negative with respect to the common voltage VC and higher than the third precharge line voltage enables, for example, precharging for supplementary writing in negative driving.

In one exemplary embodiment, the display driver 10 further includes a second data voltage output terminal (for example, TQ80) and a second amplifier circuit (AMP80) that outputs a gray scale voltage during the drive times. The display driver 10 further includes a second amplifier switching element (SA80) and a fifth precharge line switching element (SP80*a*). The second amplifier switching element (SA80) is disposed between the second amplifier circuit (AMP80) and the second data voltage output terminal (TQ80). The fifth precharge line switching element (SP80*a*) is disposed between the first precharge line (LPRa) and the second data voltage output terminal (TQ80).

Thus, the first precharge line voltage is output from the first precharge line to the first data voltage output terminal via the first precharge line switching element and to the second data voltage output terminal via the fifth precharge line switching element during the first precharge period.

Moreover, in one exemplary embodiment, the second amplifier circuit (for example, AMP80) outputs the first amplifier precharge voltage (for example, a voltage identical to the first precharge line voltage) during the first precharge period (Pr1).

Thus, the first and second amplifier circuits that drive the data lines located at different lateral positions on the electro-optic panel output the first amplifier precharge voltage during the first precharge period. As illustrated in FIG. 6, this reduces variations in precharging speed in the lateral direction of the electro-optic panel.

Moreover, in one exemplary embodiment, the distance between a supply node that supplies the first precharge line voltage (VPRa) to the first precharge line (LPRa) and the first amplifier switching element (SP40*a*) is longer than the distance between the supply node and the second amplifier switching element (SP80*a*). The driving capability of the first amplifier circuit (AMP40) is higher than the driving capability of the second amplifier circuit (AMP80).

In a case where the first precharge line voltage is supplied from outside the display driver 10 to the first precharge line as illustrated in FIG. 1, the supply node is the first precharge terminal (TPAa or TPBa). In a case where the first precharge line voltage is supplied from the power supply circuit embedded in the display driver 10 to the first precharge line, the supply node is the output node of the power supply circuit.

Moreover, the distance between the supply node and the amplifier switching element is, for example, the length of the wiring line (precharge line) that couples the supply node and the amplifier switching element. Alternatively, the distance between the supply node and the amplifier switching element may be the distance in a straight line between the supply node and the amplifier switching element.

Moreover, the driving capability of the amplifier circuit is a charge (current) supply capability of charging load capacity during precharging, and the slope of changes in the output voltage with respect to time (larger slope indicates higher driving capability) during precharging, for example, may be used as an index. For example, as described below with reference to FIG. 13, the driving capability is adjusted by changing the output resistance of the amplifier circuit. The driving capability increases as the output resistance decreases. Alternatively, the display driver 10 may include a bias circuit capable of changing the bias current of the amplifier circuit, and the driving capability may be adjusted by changing the bias current of the amplifier circuit. The driving capability increases as the bias current increases. Alternatively, the amplifier circuit may include a circuit capable of adjusting the transistor size at the output stage (for example, a circuit including a plurality of transistors coupled in parallel and switches that turn on and off the coupling of the transistors). The driving capability may be adjusted by changing the transistor size. The driving capability increases as the transistor size increases.

According to one exemplary embodiment, the amplifier circuits adjacent to the middle of the long side of the display driver 10 have higher driving capabilities compared with the amplifier circuits adjacent to the ends of the long side of the display driver 10. As indicated by A2 in FIG. 6, the speed of precharging the data lines closer to the middle of the long side of the display driver 10 tends to be slower. However, in one exemplary embodiment, the data lines closer to the middle of the long side of the display driver 10 are precharged using the amplifier circuits with higher driving capability. This reduces variations in precharging speed in the lateral direction (at the ends and the center) of the electro-optic panel.

2. Modification Examples

Figure 9:
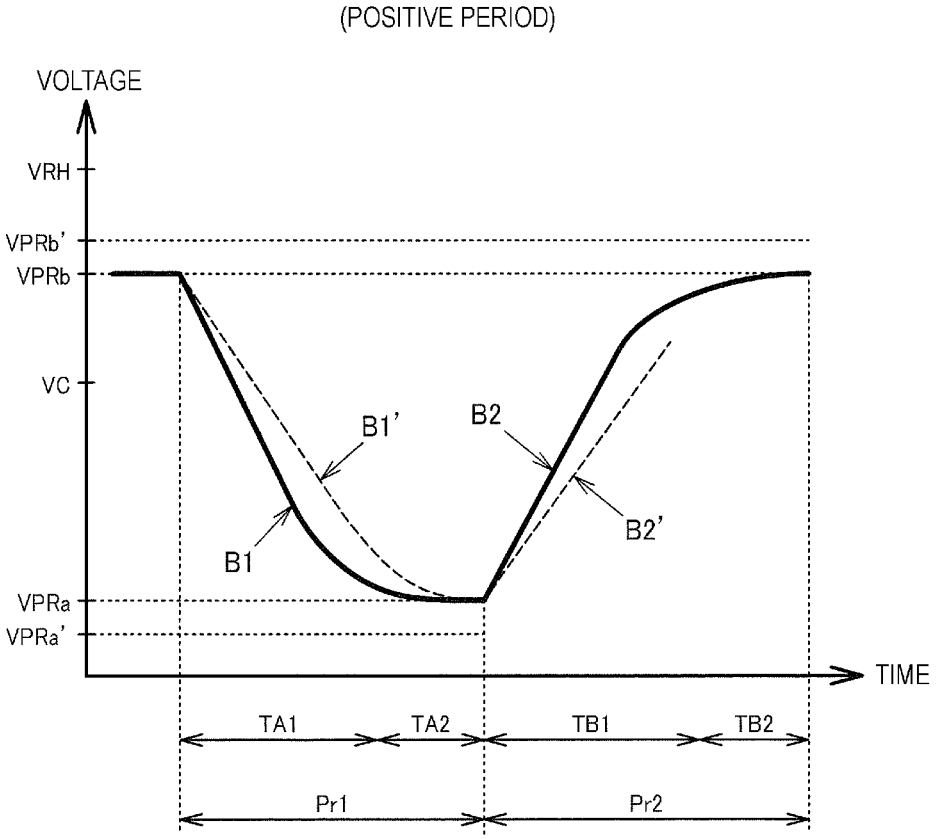
FIG. 9 illustrates a modified example of an amplifier precharge voltage.
Figure 10:
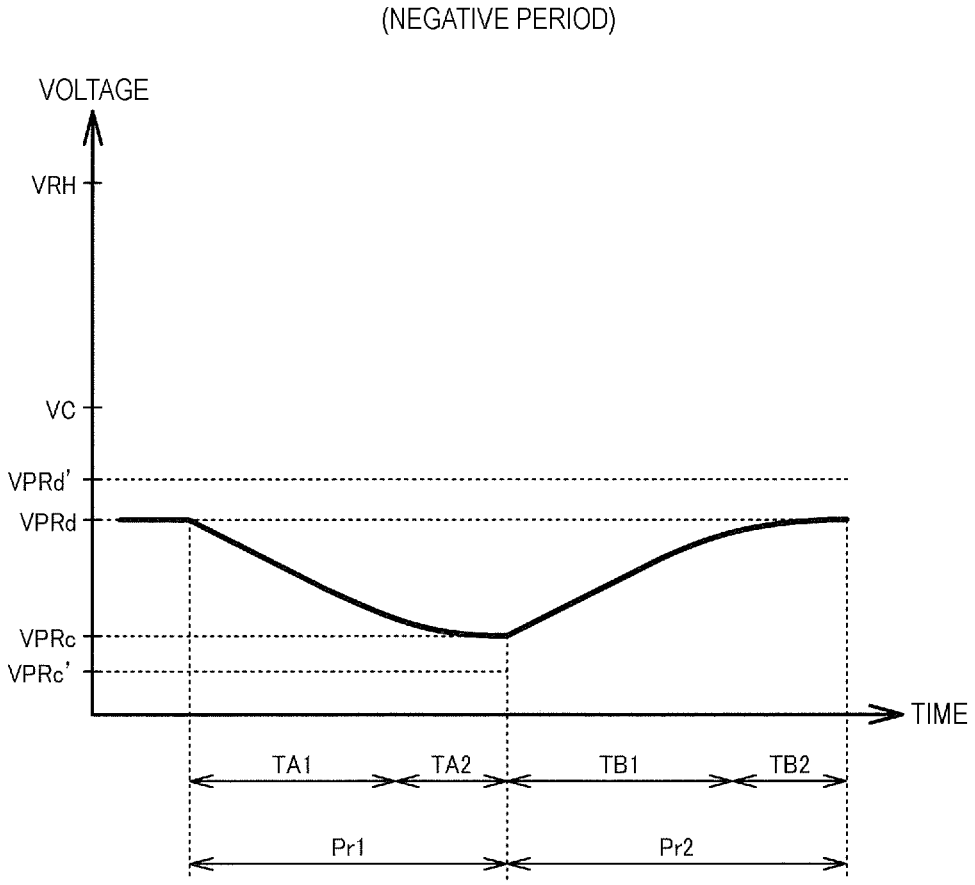
FIG. 10 illustrates the modified example of the amplifier precharge voltage.

FIGS. 9 and 10 illustrate a modified example of the amplifier precharge voltage. In this modified example, the amplifier circuits AMP1 to AMP80 output the amplifier precharge voltage that is beyond the precharge line voltage (target voltage) in a direction along which the voltage is changed by precharging.

Specifically, as illustrated in FIG. 9, the amplifier circuits AMP1 to AMP80 output a voltage VPRa' as the amplifier precharge voltage during the term TA1 of the precharge period Pr1 in the positive period. The voltage at the data voltage output terminals TQ1 to TQ80 decreases during the precharge period Pr1. The voltage VPRa' is lower than the precharge line voltage VPRa. The amplifier circuits AMP1 to AMP80 output a voltage VPRb' as the amplifier precharge voltage during the term TB1 of the precharge period Pr2. The voltage at the data voltage output terminals TQ1 to TQ80 increases during the precharge period Pr2. The voltage VPRb' is higher than the precharge line voltage VPRb.

As illustrated in FIG. 10, the amplifier circuits AMP1 to AMP80 output a voltage VPRc' as the amplifier precharge voltage during the term TA1 of the precharge period Pr1 in the negative period. The voltage at the data voltage output terminals TQ1 to TQ80 decreases during the precharge period Pr1. The voltage VPRc' is lower than the precharge line voltage VPRc. The amplifier circuits AMP1 to AMP80 output a voltage VPRd' as the amplifier precharge voltage during the term TB1 of the precharge period Pr2. The voltage at the data voltage output terminals TQ1 to TQ80 increases during the precharge period Pr2. The voltage VPRd' is higher than the precharge line voltage VPRd.

According to the modified example described above, the first amplifier circuit (for example, AMP40) outputs a first amplifier precharge voltage (VPRa') lower than the first precharge line voltage (VPRa) during the first precharge period (Pr1) in the positive period. The first amplifier circuit (AMP40) outputs the second amplifier precharge voltage (VPRb') higher than the second precharge line voltage (VPRb) during the second precharge period (Pr2) in the positive period.

Thus, the precharging speed in the positive period is increased compared with a case where the precharge line voltage and the amplifier precharge voltage are identical to each other. B1' and B2' in FIG. 9 indicate examples of changes in voltage at the data voltage output terminals (data lines) in the case where the precharge line voltage and the amplifier precharge voltage are identical to each other. In one exemplary embodiment, as indicated by B1 and B2, the voltages during precharging are changed rapidly, resulting in a reduction in time to reach the target voltages (VPRa and VPRb). For example, the target voltages (VPRa and VPRb) are also reached in a case where the precharge period is shortened due to, for example, an increase in the number of pixels of the electro-optic panel.

Moreover, in this modified example, the first amplifier circuit (for example, AMP40) outputs a third amplifier precharge voltage (VPRc') lower than the third precharge line voltage (VPRc) during the first precharge period (Pr1) in the negative period. The first amplifier circuit (AMP40) outputs a fourth amplifier precharge voltage (VPRd') higher than the fourth precharge line voltage (VPRd) during the second precharge period (Pr2) in the negative period.

Thus, the precharging speed in the negative period is increased compared with the case where the precharge line voltage and the amplifier precharge voltage are identical to each other. As in the positive period, the target voltages (VPRc and VPRd) are also reached in the case where the precharge period is shortened due to, for example, an increase in the number of pixels of the electro-optic panel.

Figure 11:
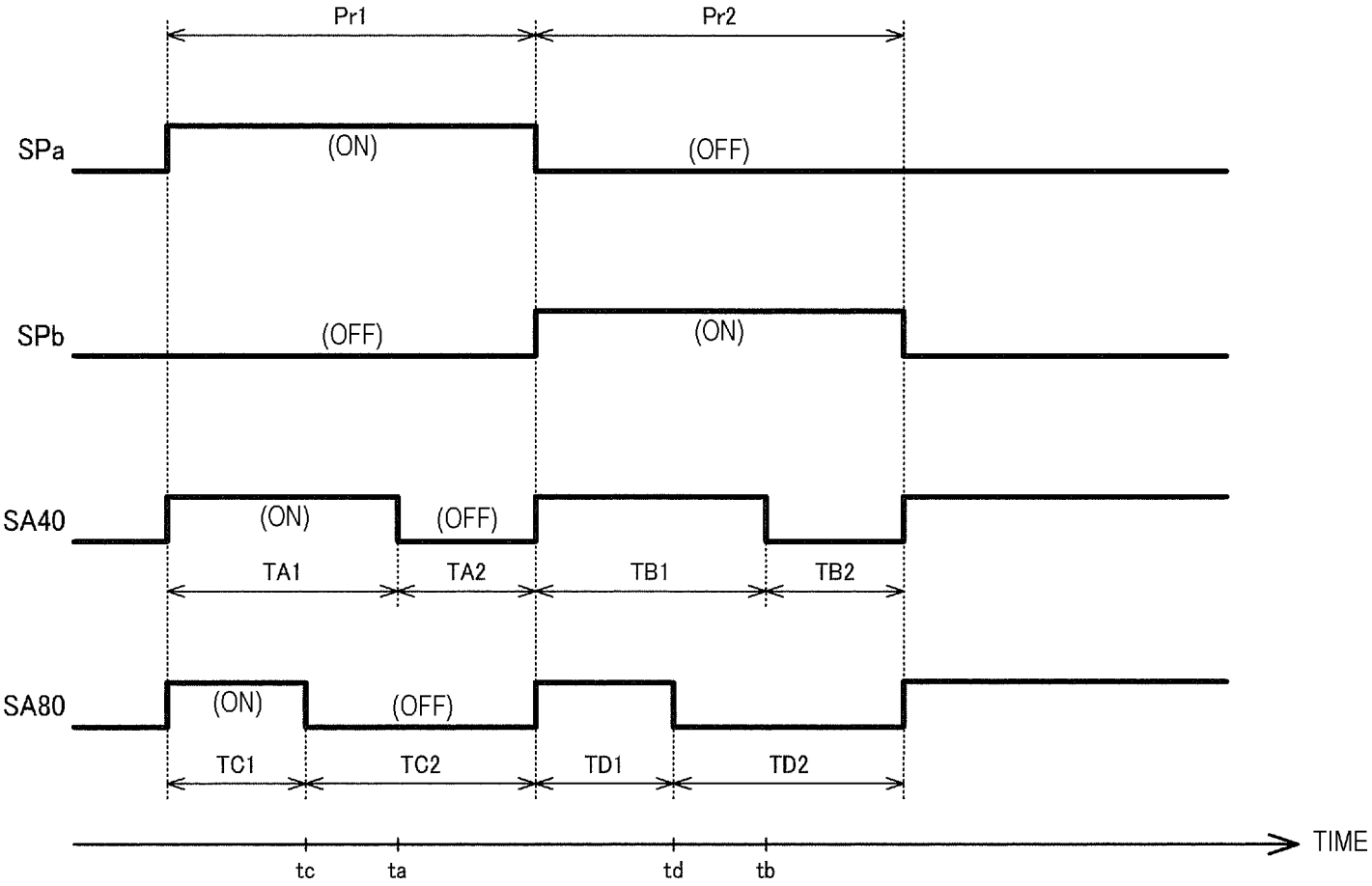
FIG. 11 illustrates a first modified example of operations of amplifier switching elements.

FIG. 11 illustrates a first modified example of operations of the amplifier switching elements. In this modified example, the durations for which the amplifier switching elements are turned on during the precharge periods vary depending on the positions of the data voltage output terminals. FIG. 11 illustrates a case in the positive period. However, the amplifier switching elements operate in a similar manner in the negative period.

As illustrated in FIG. 11, the amplifier switching element SA40 adjacent to the middle of the long side of the display driver 10 is turned on during the term TA1 of the precharge period Pr1, and turned off during the term TA2. On the other hand, the amplifier switching element SA80 adjacent to an end of the long side (adjacent to a short side) of the display driver 10 is turned on during a term TC1 of the precharge period Pr1, and turned off during a term TC2. The length of the term TA1 is greater than the length of the term TC1. That is, the amplifier switching element adjacent to the long side of the display driver 10 is turned on for a longer duration than the amplifier switching element adjacent to the end. Similarly, the amplifier switching element SA40 is turned on during the term TB1 of the precharge period Pr2, and turned off during the term TB2. The amplifier switching element SA80 is turned on during a term TD1 of the precharge period Pr2, and turned off during a term TD2. The length of the term TB1 is greater than the length of the term TD1.

FIG. 11 illustrates the example of the amplifier switching elements SA40 and SA80. However, for example, amplifier switching elements SAp to SAq may be turned on during the term TA1 of the precharge period Pr1 and during the term TB1 of the precharge period Pr2, and the amplifier switching elements SA1 to SAp−1 and SAq+1 to SA80 may be turned on during the term TC1 of the precharge period Pr1 and during the term TD1 of the precharge period Pr2, where p is an integer in the range of 2≤p≤40 and q is an integer in the range of 40≤q≤79. Alternatively, each of the amplifier switching elements SA1 to SA80 may be turned on for durations different from each other during the precharge periods Pr1 and Pr2. At this time, the durations become longer as the amplifier switching elements are located closer to the middle of the long side of the display driver 10.

According to the first modified example described above, the first amplifier switching element (for example, SA40) is turned on during the first period (TA1) of the first precharge period (Pr1), and turned off during the second period (TA2) of the first precharge period (Pr1) subsequent to the first period (TA1). The second amplifier switching element (for example, SA80) is turned on during a third period (TC1) of the first precharge period (Pr1) shorter than the first period (TA1), and turned off during a fourth period (TC2) of the first precharge period (Pr1) subsequent to the third period (TC1).

Thus, the amplifier circuits adjacent to the middle of the long side of the display driver 10 output the amplifier precharge voltage for longer durations than the amplifier circuits adjacent to the ends of the long side of the display driver 10. As indicated by A2 in FIG. 6, the speed of precharging the data lines closer to the middle of the long side of the display driver 10 tends to be slower. However, in one exemplary embodiment, the data lines closer to the middle of the long side of the display driver 10 are precharged using the amplifier precharge voltage for longer durations. This reduces variations in precharging speed in the lateral direction (at the ends and the center) of the electro-optic panel.

In this modified example, the display driver 10 further includes a setting circuit (for example, a setting circuit 152 in FIG. 15) configured to set the lengths of the first period (TA1) and the third period (TC1), or to set a timing to of switching from the first period (TA1) to the second period (TA2) and a timing tc of switching from the third period (TC1) to the fourth period (TC2), where tc<ta.

Thus, the lengths of the first period (TA1) and the third period (TC1) are variable and adjustable. Load capacity during precharging varies depending on, for example, the type or model of the electro-optic panel. Thus, the duration for which the precharge line voltage and the amplifier precharge voltage are used together varies depending on the type or model of the electro-optic panel. In one exemplary embodiment, the lengths of the first period (TA1) and the third period (TC1) are variable and adjustable depending on the type or model of the electro-optic panel.

The setting circuit sets the lengths of the term TB1 and the term TD1, or sets a timing tb of switching from the term TB1 to the term TB2 and a timing td of switching from the term TD1 to the term TD2, where td<tb. Thus, the lengths of the term TB1 and the term TD1 are variable and adjustable.

Figure 12:
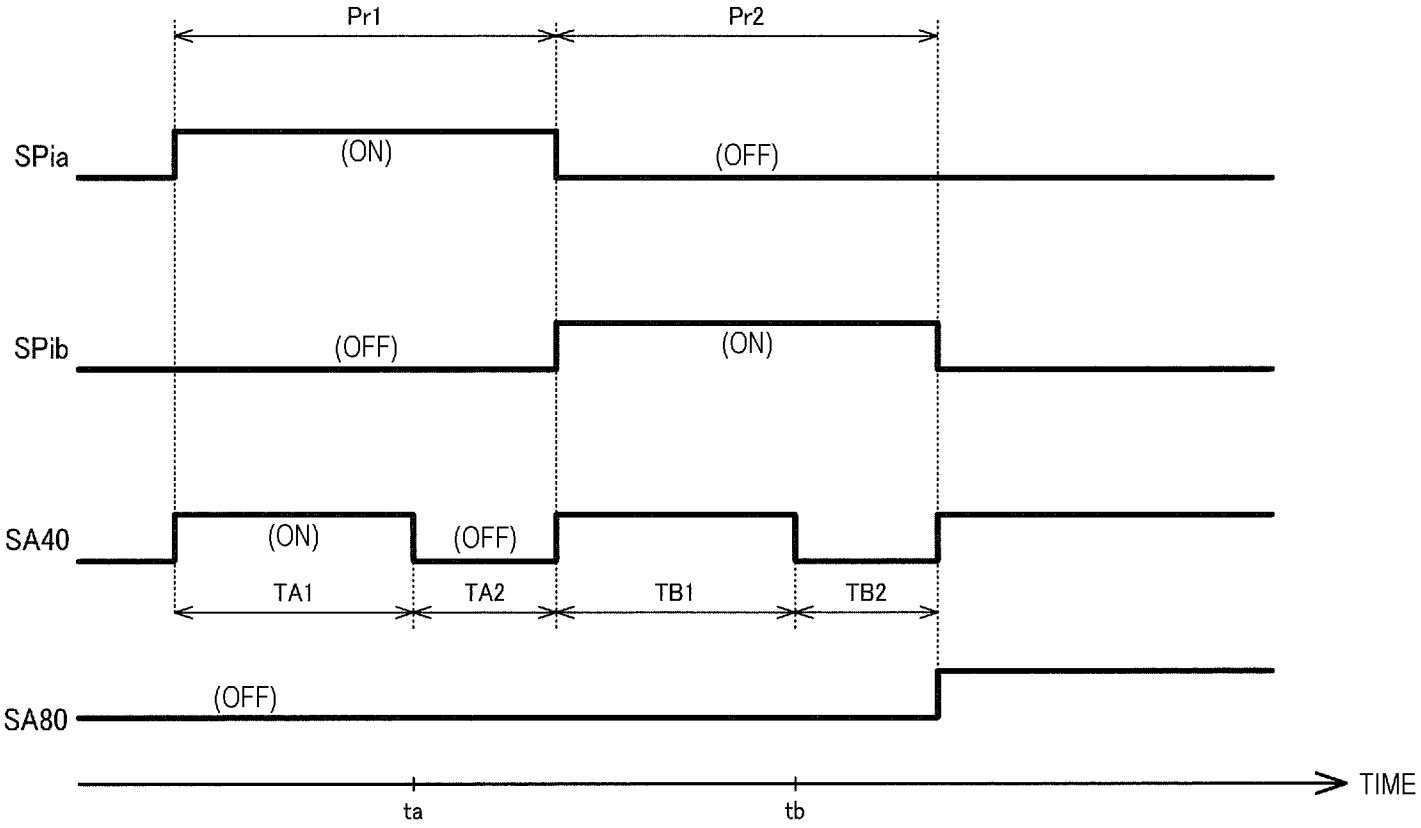
FIG. 12 illustrates a second modified example of operations of the amplifier switching elements.

FIG. 12 illustrates a second modified example of operations of the amplifier switching elements. In this modified example, the amplifier switching elements are turned on or off depending on the positions of the data voltage output terminals during the precharge periods. FIG. 12 illustrates a case in the positive period. However, the amplifier switching elements operate in a similar manner in the negative period.

As illustrated in FIG. 12, the amplifier switching element SA40 adjacent to the middle of the long side of the display driver 10 is turned on during the term TA1 of the precharge period Pr1, and turned off during the term TA2. Similarly, the amplifier switching element SA40 is turned on during the term TB1 of the precharge period Pr2, and turned off during the term TB2. On the other hand, the amplifier switching element SA80 adjacent to the end of the long side (adjacent to the short side) of the display driver 10 is turned off (not turned on) during the precharge periods Pr1 and Pr2. That is, the amplifier switching element adjacent to the long side of the display driver 10 is turned on for a certain duration, and the amplifier switching element adjacent to the end is kept turned off.

FIG. 12 illustrates the example of the amplifier switching elements SA40 and SA80. However, for example, the amplifier switching elements SAp to SAq may be turned on during the term TA1 of the precharge period Pr1 and for during term TB1 of the precharge period Pr2, and the amplifier switching elements SA1 to SAp−1 and SAq+1 to SA80 may be turned off during the precharge periods Pr1 and Pr2.

According to the second modified example described above, the first amplifier switching element (for example, SA40) is turned on during the first period (TA1) of the first precharge period (Pr1), and turned off during the second period (TA2) of the first precharge period (Pr1) subsequent to the first period (TA1). The second amplifier switching element (for example, SA80) is turned off during the first precharge period (Pr1).

Thus, the precharge line voltage and the amplifier precharge voltage are used together adjacent to the middle of the long side of the display driver 10 while the precharge line voltage is used adjacent to the ends of the long side of the display driver 10. As indicated by A2 in FIG. 6, the speed of precharging the data lines closer to the middle of the long side of the display driver 10 tends to be slower. However, in one exemplary embodiment, the data lines adjacent to the middle of the long side of the display driver 10 are precharged using the precharge line voltage and the amplifier precharge voltage together. This reduces variations in precharging speed in the lateral direction (at the ends and the center) of the electro-optic panel.

The setting circuit described in the first modified example may set the length of the term TA1 or set the timing to of switching from the term TA1 to the term TA2. The setting circuit may also set the length of the term TB1 or set the timing tb of switching from the term TB1 to the term TB2.

Figure 13:
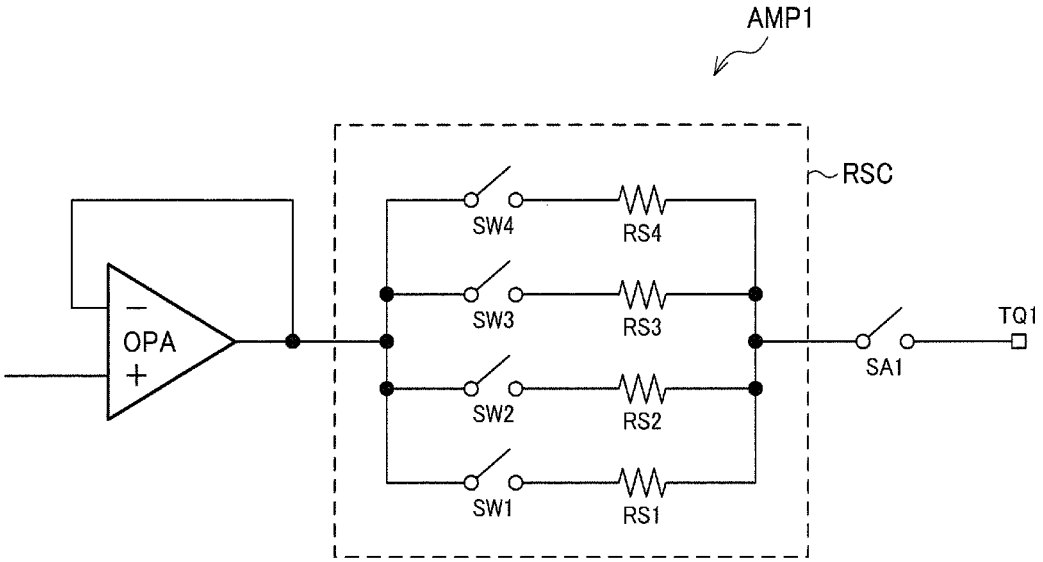
FIG. 13 illustrates a detailed configuration example of an amplifier circuit.

3. Amplifier Circuit, Amplifier Switching Element, and Precharge Line Switching Element FIG. 13 illustrates a detailed configuration example of the amplifier circuit. The amplifier circuits AMP2 to AMP80 may have similar configurations.

The amplifier circuit AMP1 includes an operational amplifier OPA configured as a voltage follower, the amplifier switching element SA1, and a resistance circuit RSC disposed between the output of the voltage follower and an end of the amplifier switching element SA1.

The resistance circuit RSC includes switching elements (switches) SW1 to SW4 and resistance elements (resistors) RS1 to RS4. The switching element SW1 and the resistance element RS1 are coupled in series between the output of the voltage follower and the end of the amplifier switching element SA1. Similarly, the switching element SW2 and the resistance element RS2, the switching element SW3 and the resistance element RS3, and the switching element SW4 and the resistance element RS4 are respectively coupled in series between the output of the voltage follower and the end of the amplifier switching element SA1. The other end of the amplifier switching element SA1 is coupled with the data voltage output terminal TQ1. Each of the switching elements SW1 to SW4 includes, for example, a transistor. For example, each includes a transfer gate in which a P-type transistor and an N-type transistor are coupled in parallel.

The resistance value of the resistance circuit (variable resistance circuit) RSC is set to a first resistance value during the drive times Gs1 to Gs8, and set to a second resistance value lower than the first resistance value during the precharge periods Pr1 and Pr2. The resistance value of the resistance circuit RSC is set according to the combination of on-state and off-state of the switching elements SW1 to SW4. A reduction in the resistance value of the resistance circuit RSC during the precharge periods Pr1 and Pr2 decreases the load (load resistance) to the voltage follower, and thus increases the precharging speed.

Moreover, the resistance value of the resistance circuit RSC during the precharge periods may vary at the amplifier circuit adjacent to the middle of the long side of the display driver 10 and at the amplifier circuits adjacent to the ends of the long side of the display driver 10. Specifically, the resistance value of the resistance circuit RSC during the precharge periods is smaller at the amplifier circuit adjacent to the middle of the long side of the display driver 10 than at the amplifier circuits adjacent to the ends of the long side of the display driver 10.

Figure 14:
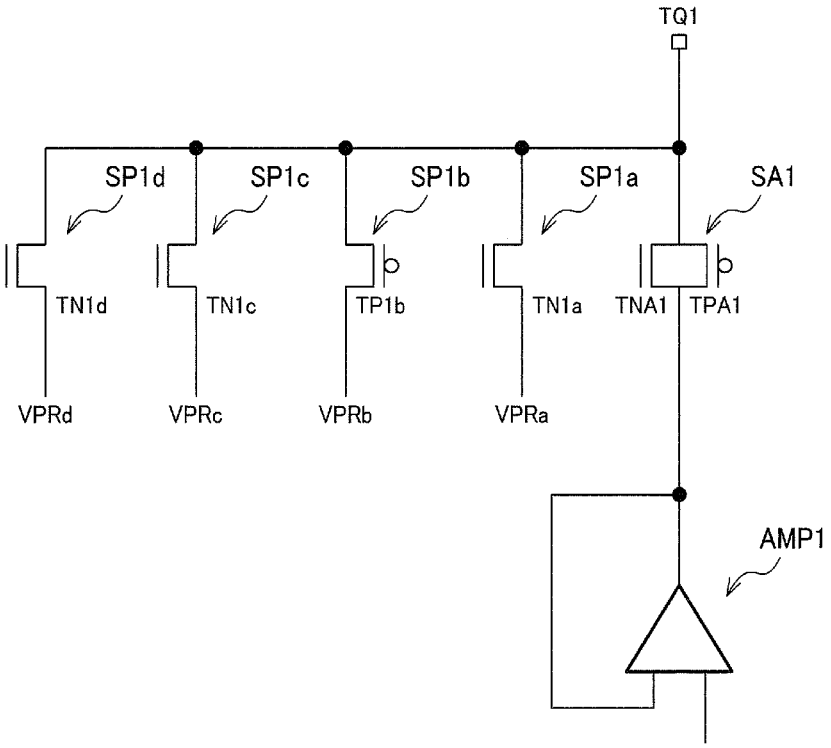
FIG. 14 illustrates a detailed configuration example of the amplifier switching element and precharge line switching elements.

FIG. 14 illustrates a detailed configuration example of the amplifier switching element and the precharge line switching elements. FIG. 14 illustrates an example of the switching elements SA1 and SP1*a* to SP1*d*. However, the switching elements SA2 to SA80 and SP2*a* to SP80*a*, SP2*b* to SP80*b*, SP2*c* to SP80*c*, and SP2*d* to SP80*d* may also have similar configurations.

The amplifier switching element SA1 is a transfer gate including a P-type transistor TPA1 and an N-type transistor TNA1. The sources (or drains) of the transistors TPA1 and TNA1 are coupled with the output of the amplifier circuit AMP1, and the drains (or sources) are coupled with the data voltage output terminal TQ1. The precharge line switching elements SP1*a*, SP1*c*, and SP1*d* are respectively N-type transistors TN1*a*, TN1*c*, and TN1*d*. The sources (or drains) of the transistors TN1*a*, TN1*c*, and TN1*d* are respectively coupled with nodes (precharge lines LPRa, LPRc, and LPRd) at the precharge line voltages VPRa, VPRc, and VPRd, and the drains (or sources) are coupled with the data voltage output terminal TQ1. The precharge line switching elements SP1*b* is a P-type transistor TP1*b*. The source (or drain) of the transistor TP1*b* is coupled with a node (precharge line LPRb) at the precharge line voltage VPRb, and the drain (or source) is coupled with the data voltage output terminal TQ1.

The configurations of the precharge line switching elements SP1*a* to SP1*d* are not limited to this, and each of the precharge line switching elements SP1*a* to SP1*d* may be a transfer gate.

According to the detailed configuration example described above, the first precharge line switching element (for example, SP40*a*), the third precharge line switching element (SP40*c*), and the fourth precharge line switching element (SP40*d*) are N-type transistors. The second precharge line switching element (SP40*b*) is a P-type transistor.

As illustrated with reference to FIG. 2, the first precharge line voltage (VPRa), the third precharge line voltage (VPRc), and the fourth precharge line voltage (VPRd) are negative voltages lower than the common voltage VC. Thus, N-type transistors may be used as the first, third, and fourth precharge line switching elements. Moreover, the second precharge line voltage (VPRb) is a positive voltage higher than the common voltage VC. Thus, a P-type transistor may be used as the second precharge line switching element.

4. Second Configuration Example of Display Driver

Figure 15:
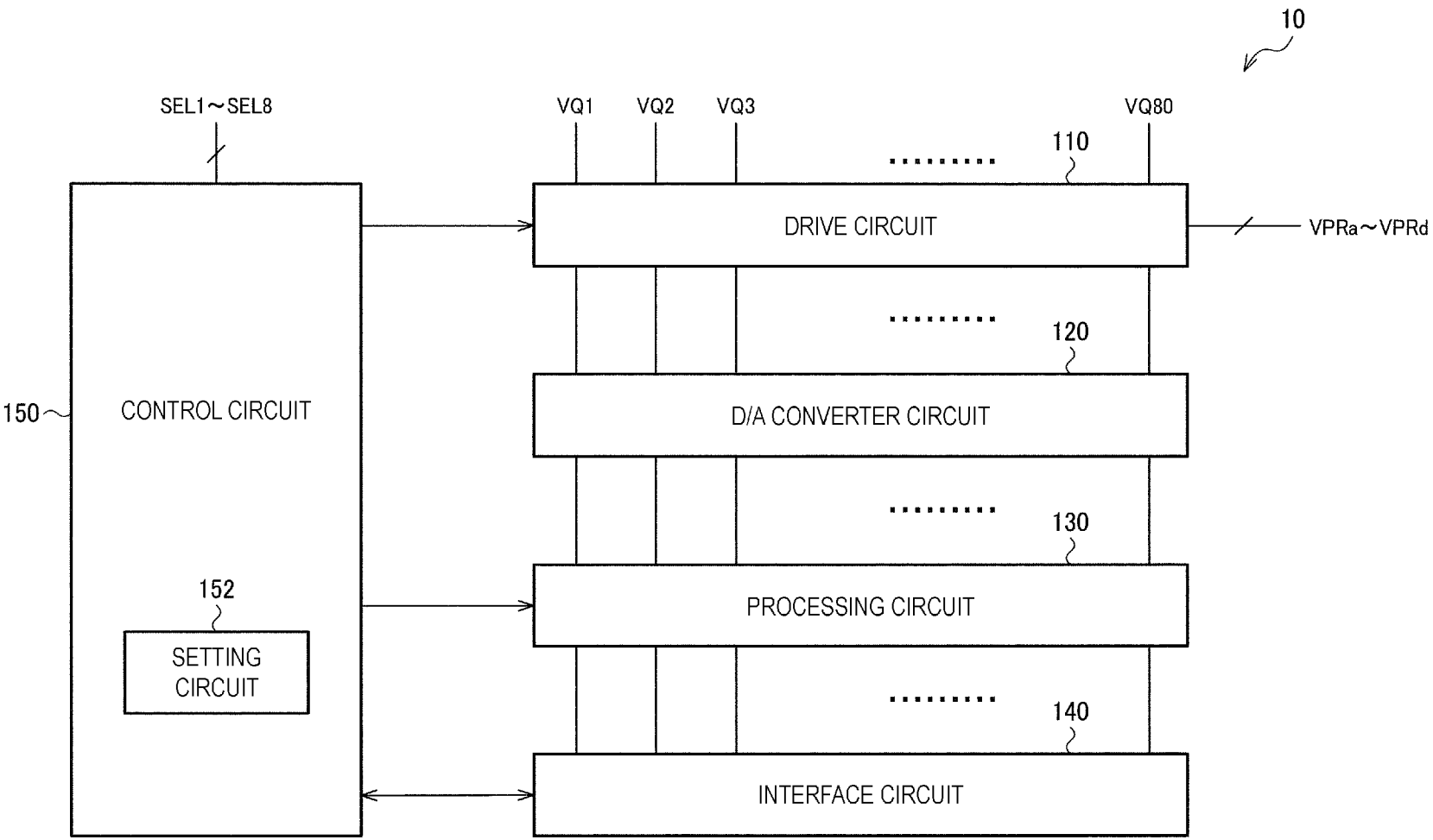
FIG. 15 illustrates a second configuration example of the display driver according to one exemplary embodiment.

FIG. 15 illustrates a second configuration example of the display driver according to one exemplary embodiment. The display driver 10 includes a drive circuit 110, the D/A converter circuit 120, a processing circuit 130, an interface circuit 140, and a control circuit 150.

The interface circuit 140 performs communication between the display driver 10 and processors (for example, a CPU, an MPU, and a display controller) outside the display driver 10. For example, the interface circuit 140 receives image data and setting data (for example, set values for a register and commands) sent by the processors, and sends various data (for example, data read out of the register) to the processors. The interface circuit 140 may communicate using, for example, SPI, I2C, LVDS, or RGB serial interface.

The processing circuit 130 performs data processing on image data received by the interface circuit 140, and outputs the processed image data to the D/A converter circuit 120. For example, the processing circuit 130 performs multiplex processing in multiplex driving. That is, the processing circuit 130 latches image data for one line, and outputs pixel data for the number of multiplexing (for example, data for eight pixels) in a time division manner during one horizontal scanning period. Alternatively, the processing circuit 130 may perform processing such as gamma correction, white balance, and FRC processing. The processing circuit 130 may include, for example, a line latch or a multiplexer. Alternatively, the processing circuit 130 may be a logic circuit (gate array) configured by automatically arranged wiring line.

The D/A converter circuit 120 performs D/A conversion on the time division image data output from the processing circuit 130, and outputs time division gray scale voltages corresponding to the time division pixel data. The D/A converter circuit 120 includes a voltage generating circuit (for example, ladder resistance circuit) that generates a plurality of voltages and a voltage selecting circuit (switching circuit) that selects voltages corresponding to the pixel data from the plurality of voltages.

The drive circuit 110 amplifies (or buffers) the time division gray scale voltages from the D/A converter circuit 120, and outputs data voltages VQ1 to VQ80 (gray scale voltages) to the data lines of the electro-optic panel. The drive circuit 110 also precharges the electro-optic panel during the precharge periods. The drive circuit 110 includes the amplifier circuits AMP1 to AMP80, the amplifier switching elements SA1 to SA80, and the precharge line switching elements SP1*a* to SP80*a*, SP1*b* to SP80*b*, SP1*c* to SP80*c*, and SP1*d* to SP80*d* described with reference to, for example, FIG. 1. The amplifier circuits AMP1 to AMP80 receive the time division gray scale voltages from the D/A converter circuit 120.

The amplifier precharge voltages may be output, for example, as follows. That is, the processing circuit 130 outputs data corresponding to the amplifier precharge voltages to the D/A converter circuit 120, and the D/A converter circuit 120 performs D/A conversion on the data. The amplifier circuits AMP1 to AMP80 amplify (buffer) the voltages after D/A conversion, and output the voltages as the amplifier precharge voltages to the data lines of the electro-optic panel.

The control circuit 150 performs various controls on various units of the display driver 10. For example, the control circuit 150 controls the timing of driving the electro-optic panel based on the image data or timing control signals received via the interface circuit 140. Alternatively, the control circuit 150 performs, for example, operation settings of the various units of the display driver 10 based on setting information or commands received via the interface circuit 140. For example, the control circuit 150 outputs signals SEL1 to SEL8 that control the demultiplexer of the electro-optic panel. The switching elements SD1 to SD8 of the demultiplexer DMX in FIG. 3 are turned on and off using the signals SEL1 to SEL8. The control circuit 150 also turns on and off the amplifier switching elements SA1 to SA80 and the precharge line switching elements SP1*a* to SP80*a*, SP1*b* to SP80*b*, SP1*c* to SP80*c*, and SP1*d* to SP80*d*. The control circuit 150 also turns on and off the switching elements SW1 to SW4 of the resistance circuit RSC in FIG. 13. The control circuit 150 also outputs setting information for the amplifier precharge voltages to the processing circuit 130. The processing circuit 130 outputs data corresponding to the amplifier precharge voltages to the D/A converter circuit 120 based on the setting information. The control circuit 150 further includes the setting circuit 152 that sets the durations for which the amplifier switching elements SA1 to SA80 are turned on. For example, the setting circuit 152 is a register, and the information about the duration information is written from the processing circuit into the register via the interface circuit 140. The control circuit 150 turns on and off the amplifier switching elements SA1 to SA80 of the drive circuit 110 based on the duration information stored in the register. The control circuit 150 is a logic circuit (gate array) configured by, for example, automatically arranged wiring line.

5. Electro-Optic Device and Electronic Apparatus

Figure 16:
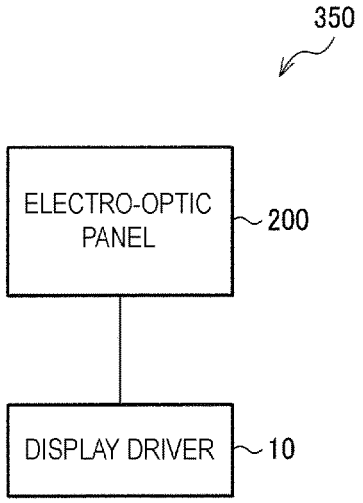
FIG. 16 illustrates a configuration example of an electro-optic device.

FIG. 16 is a configuration example of an electro-optic device including the display driver according to one exemplary embodiment. An electro-optic device 350 includes the display driver 10 and the electro-optic panel 200.

The electro-optic panel 200 is, for example, a liquid crystal display panel of an active matrix type. For example, the display driver 10 is mounted on a flexible substrate, and the flexible substrate is coupled with the electro-optic panel 200 to couple the data voltage output terminals of the display driver 10 with the data lines of the electro-optic panel 200 by wiring lines formed on the flexible substrate. Alternatively, the display driver 10 may be mounted on a rigid substrate (printed board), and the rigid substrate may be coupled with the electro-optic panel 200 using a flexible substrate to couple the data voltage output terminals of the display driver 10 with the data lines of the electro-optic panel 200 by wiring lines formed on the flexible substrate. Yet alternatively, the display driver 10 may be mounted on a glass substrate of the electro-optic panel 200, and the data voltage output terminals of the display driver 10 may be coupled with the data lines of the electro-optic panel 200 by wiring lines of transparent electrodes (indium tin oxide; ITO) formed on the glass substrate.

Figure 17:
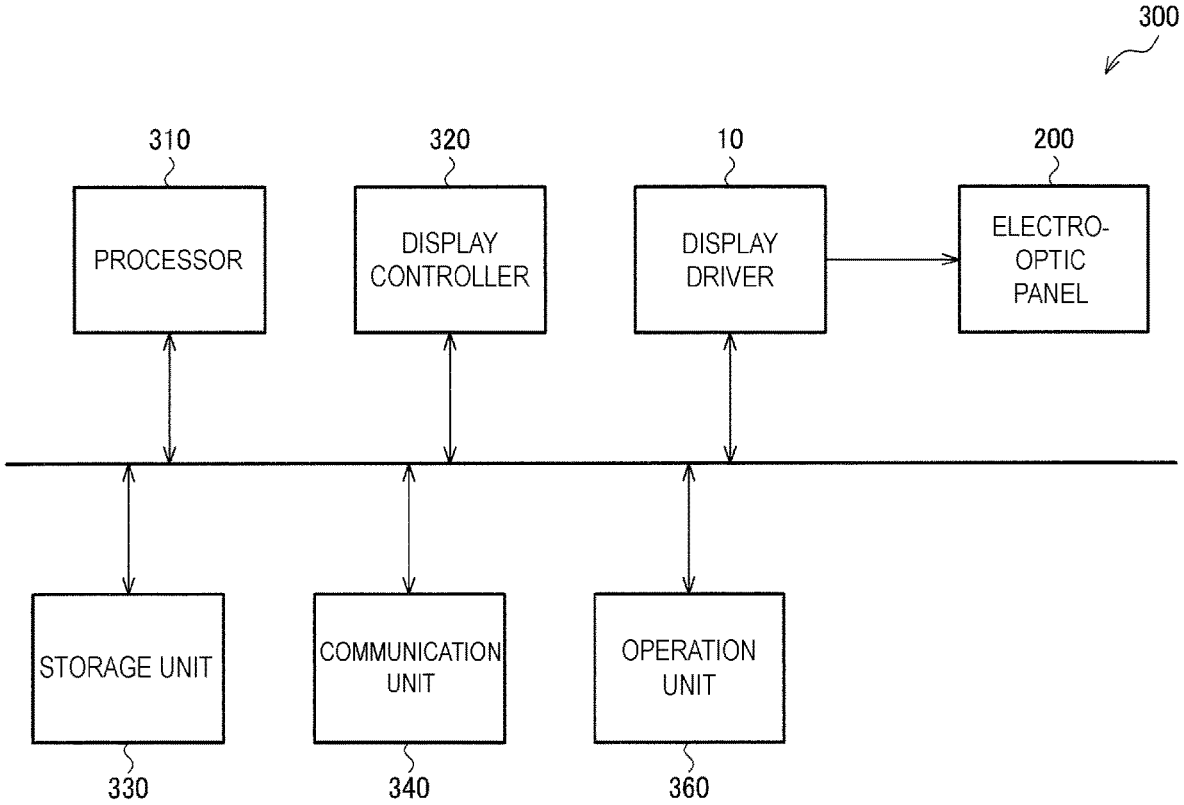
FIG. 17 illustrates a configuration example of an electronic apparatus.

FIG. 17 is a configuration example of an electronic apparatus including the display driver according to one exemplary embodiment. An electronic apparatus 300 includes a processor 310, a display controller 320, the display driver 10, the electro-optic panel 200, a storage unit 330 (storage device or memory), a communication unit 340 (communication circuit or communication device), and an operation unit 360 (operation device). Examples of the electronic apparatus 300 include various electronics including display devices such as projectors, head mounted displays, personal digital assistants, in-vehicle devices (for example, meter panels and car navigation systems), portable gaming consoles, and information processors.

The operation unit 360 is an interface that receives various operations from users. For example, the operation unit 360 is buttons, a mouse, a keyboard, or a touch panel or the like installed in the electro-optic panel 200. The communication unit 340 is a data interface that inputs and outputs image data and control data. The communication unit 340 is, for example, a radio communication interface such as wireless LAN and near field communication or a wired communication interface such as wired LAN and a USB. The storage unit 330, for example, stores data input from the communication unit 340, or functions as a working memory of the processor 310. The storage unit 330 is, for example, memory such as RAM and ROM, a magnetic storage such as a HDD, or an optical storage such as a CD drive and a DVD drive. The display controller 320 processes image data (display data) input from the communication unit 340 or stored in the storage unit 330, and transfers the data to the display driver 10. The display driver 10 displays images on the electro-optic panel 200 based on the image data transferred from the display controller 320. The processor 310 controls the electronic apparatus 300, and performs various signal processings. The processor 310 is, for example, a processor such as a CPU and an MPU or an ASIC.

For example, in a case where the electronic apparatus 300 is a projector, the electronic apparatus 300 further includes a light source and optical units (for example, lenses, prisms, and mirrors). In a case where the electro-optic panel 200 is of a transmissive type, the optical units lead the light from the light source to the electro-optic panel 200 to project the light passing through the electro-optic panel 200 onto a screen. In a case where the electro-optic panel 200 is of a reflective type, the optical units lead the light from the light source to the electro-optic panel 200 to project the light reflected from the electro-optic panel 200 onto a screen.

Although some exemplary embodiments are described above in detail, it will be easily understood by persons skilled in the art that many modifications substantially not deviating from new matters and effects of the disclosure are possible. Therefore, such modified examples shall be included within the scope of the disclosure. For example, terms described at least once in the specification or the drawings along with different synonymous or broader terms may be replaced with different terms at any point in the specification or the drawings. Moreover, any combinations of some exemplary embodiments and the modified examples are included within the scope of the disclosure. Furthermore, the configurations and the operations of the display driver, the electro-optic device, and the electronic apparatus are not limited to the descriptions in some exemplary embodiments, and various modifications are possible.

This application claims priority to Japan Patent Application No. 2017-152113 filed Aug. 7, 2017, the entire disclosures of which are hereby incorporated by reference in their entireties.

What is claimed is:

1. A display driver comprising:

a first data voltage output terminal;

a first amplifier circuit configured to output a gray scale voltage during a drive time, and to output a first amplifier precharge voltage during a first precharge period, the first amplifier precharge voltage comprising a predetermined voltage applied to pixels of an electro-optic device before data voltages are written into the pixels of the electro-optic device;

a first precharge line configured to supply a first precharge line voltage;

a first amplifier switching element disposed between the first amplifier circuit and the first data voltage output terminal;

a first precharge line switching element disposed between the first precharge line and the first data voltage output terminal;

a second precharge line configured to supply a second precharge line voltage; and a second precharge line switching element disposed between the second precharge line and the first data voltage output terminal, wherein the first precharge line voltage is a negative voltage with respect to a common voltage, the second precharge line voltage is a positive voltage with respect to the common voltage, the first precharge line switching element is turned on during the first precharge period in a positive period, the second precharge line switching element is turned on during a second precharge period subsequent to the first precharge period in the positive period, and the first amplifier circuit outputs the first amplifier precharge voltage lower than the first precharge line voltage during the first precharge period in the positive period, and outputs a second amplifier precharge voltage higher than the second precharge line voltage during the second precharge period in the positive period.

2. The display driver according to claim 1, wherein the first amplifier switching element and the first precharge line switching element are turned on during a first period of the first precharge period, and the first amplifier switching element is turned off and the first precharge line switching element is turned on during a second period of the first precharge period, the second period being subsequent to the first period.

3. The display driver according to claim 1, further comprising a first precharge terminal configured to supply the first precharge line voltage to the first precharge line from outside the display driver.

4. The display driver according to claim 1, further comprising:

a second data voltage output terminal;

a second amplifier circuit configured to output a gray scale voltage during the drive time;

a second amplifier switching element disposed between the second amplifier circuit and the second data voltage output terminal; and a fifth precharge line switching element disposed between the first precharge line and the second data voltage output terminal.

5. The display driver according to claim 4, wherein the second amplifier circuit outputs the first amplifier precharge voltage during the first precharge period.

6. An electro-optic device comprising:

the display driver according to claim 1; and an electro-optic panel to be driven by the display driver.

7. An electronic apparatus comprising:

the display driver according to claim 1.

8. A display driver comprising:

a first data voltage output terminal;

a first amplifier circuit configured to output a gray scale voltage during a drive time, and to output a first amplifier precharge voltage during a first precharge period, the first amplifier precharge voltage comprising a predetermined voltage applied to pixels of an electro-optic device before data voltages are written into the pixels of the electro-optic device;

a first precharge line configured to supply a first precharge line voltage;

a first amplifier switching element disposed between the first amplifier circuit and the first data voltage output terminal;

a first precharge line switching element disposed between the first precharge line and the first data voltage output terminal;

a second precharge line configured to supply a second precharge line voltage;

a second precharge line switching element disposed between the second precharge line and the first data voltage output terminal;

a third precharge line configured to supply a third precharge line voltage;

a fourth precharge line configured to supply a fourth precharge line voltage;

a third precharge line switching element disposed between the third precharge line and the first data voltage output terminal; and a fourth precharge line switching element disposed between the fourth precharge line and the first data voltage output terminal.

9. The display driver according to claim 8, wherein the third precharge line voltage is a negative voltage with respect to a common voltage, the fourth precharge line voltage is a negative voltage with respect to the common voltage and higher than the third precharge line voltage, the third precharge line switching element is turned on during the first precharge period in a negative period, and the fourth precharge line switching element is turned on during a second precharge period subsequent to the first precharge period in the negative period.

10. The display driver according to claim 9, wherein the first amplifier circuit outputs a third amplifier precharge voltage lower than the third precharge line voltage during the first precharge period in the negative period, and outputs a fourth amplifier precharge voltage higher than the fourth precharge line voltage during the second precharge period in the negative period.

11. The display driver according to claim 8, wherein the first precharge line switching element, the third precharge line switching element, and the fourth precharge line switching element are N-type transistors, and the second precharge line switching element is a P-type transistor.

12. An electronic apparatus comprising:

the display driver according to claim 8.

13. The display driver according to claim 8, wherein the first amplifier switching element and the first precharge line switching element are turned on during a first period of the first precharge period, and the first amplifier switching element is turned off and the first precharge line switching element is turned on during a second period of the first precharge period, the second period being subsequent to the first period.

14. The display driver according to claim 8, further comprising a first precharge terminal configured to supply the first precharge line voltage to the first precharge line from outside the display driver.

15. A display driver comprising:

a first data voltage output terminal;

a first amplifier circuit configured to output a gray scale voltage during a drive time, and to output a first amplifier precharge voltage during a first precharge period, the first amplifier precharge voltage comprising a predetermined voltage applied to pixels of an electro-optic device before data voltages are written into the pixels of the electro-optic device;

a first precharge line configured to supply a first precharge line voltage;

a first amplifier switching element disposed between the first amplifier circuit and the first data voltage output terminal; and a first precharge line switching element disposed between the first precharge line and the first data voltage output terminal;

a second data voltage output terminal;

a second amplifier circuit configured to output a gray scale voltage during the drive time;

a second amplifier switching element disposed between the second amplifier circuit and the second data voltage output terminal; and a fifth precharge line switching element disposed between the first precharge line and the second data voltage output terminal, wherein a distance between a supply node configured to supply the first precharge line voltage to the first precharge line and the first amplifier switching element is longer than a distance between the supply node and the second amplifier switching element, and a driving capability of the first amplifier circuit is higher than a driving capability of the second amplifier circuit.

16. The display driver according to claim 15, wherein the first amplifier switching element is turned on during a first period of the first precharge period, and is turned off during a second period of the first precharge period, the second period being subsequent to the first period, and the second amplifier switching element is turned off during the first precharge period.

17. The display driver according to claim 15, wherein the first amplifier switching element is turned on during a first period of the first precharge period, and turned off during a second period of the first precharge period subsequent to the first period, and the second amplifier switching element is turned on during a third period of the first precharge period, the third period being shorter than the first period, and turned off during a fourth period of the first precharge period, the fourth period being subsequent to the third period.

18. The display driver according to claim 17, further comprising:

a setting circuit configured to set lengths of the first period and the third period, or to set a timing of switching between the first period and the second period and a timing of switching between the third period and the fourth period.

19. An electronic apparatus comprising:

the display driver according to claim 15.

20. The display driver according to claim 15, wherein the first amplifier switching element and the first precharge line switching element are turned on during a first period of the first precharge period, and the first amplifier switching element is turned off and the first precharge line switching element is turned on during a second period of the first precharge period, the second period being subsequent to the first period.

* * * * *